US006753844B2

(12) United States Patent
Machida et al.

(10) Patent No.: US 6,753,844 B2
(45) Date of Patent: Jun. 22, 2004

(54) IMAGE DISPLAY DEVICE AND DISPLAY DRIVE METHOD

(75) Inventors: Yoshinori Machida, Ashigarakami-gun (JP); Kiyoshi Shigehiro, Ashigarakami-gun (JP); Yasufumi Suwabe, Ashigarakami-gun (JP); Yoshiro Yamaguchi, Ashigarakami-gun (JP); Motohiko Sakamaki, Ashigarakami-gun (JP); Takeshi Matsunaga, Ashigarakami-gun (JP)

(73) Assignee: Fuji Xerox Co., Ltd., Tokyo (JP)

( * ) Notice: Subject to any disclaimer, the term of this patent is extended or adjusted under 35 U.S.C. 154(b) by 112 days.

(21) Appl. No.: 10/014,533

(22) Filed: Dec. 14, 2001

(65) Prior Publication Data

US 2002/0196207 A1 Dec. 26, 2002

(30) Foreign Application Priority Data

Jun. 20, 2001 (JP) ..... 2001-187096

(51) Int. Cl.[7] ..... G09G 3/34
(52) U.S. Cl. ..... 345/107; 359/296
(58) Field of Search ..... 345/107, 204; 359/296; 204/450, 600; 430/32, 38

(56) References Cited

U.S. PATENT DOCUMENTS 3,655,267 A * 4/1972 Forlini ..... 359/253
3,668,106 A * 6/1972 Ota ..... 204/299
3,792,308 A * 2/1974 Ota ..... 315/150
4,272,596 A * 6/1981 Harbour et al. ..... 430/37
4,746,917 A * 5/1988 Di Santo et al. ..... 340/787
4,806,443 A * 2/1989 Yanus et al. ..... 430/56

FOREIGN PATENT DOCUMENTS

JP A 2000-347483 12/2000
JP A 2001-33833 2/2001
JP A 2001-312225 11/2001

OTHER PUBLICATIONS

Gugrae–Jo et al., "New Toner Display Device (II)", Japan Hardcopy' 99 Fall Proceedings, pp. 10–13, 1999.
Gugrae–Jo et al., "New Toner Display Device (I)", Japan Hardcopy' 99 theses, pp. 249–252, 1999.

* cited by examiner

*Primary Examiner*—Lun-Yi Lao
(74) *Attorney, Agent, or Firm*—Oliff & Berridge, PLC

(57) ABSTRACT

An image display device is structured with an image display medium, a voltage applying unit and a control unit. The image display medium has black particles and white particles enclosed in a space between a transparent front substrate and a rear substrate. The front substrate is structured with a lamination having a substrate, an electrode and a surface coat layer. The rear substrate is structured with a lamination having a substrate, an electrode and a surface coat layer. The electrode on the front substrate is connected to the voltage applying unit while the voltage applying unit is connected to the control unit. The control unit controls the voltage applying unit to apply to the electrodes of the substrates an alternating voltage at a frequency of from 20 Hz to 20 kHz.

19 Claims, 24 Drawing Sheets

FIG. 8

| FREQUENCY (Hz) | 5 | 10 | 20 | 30 | 50 | 100 | 1k | 2k | 10k | 20k | 30k |
|---|---|---|---|---|---|---|---|---|---|---|---|
| PARTICLE-COAGULATION DISSOCIATING EFFECT | × | × | △ | ○ | ◎ | ◎ | ◎ | ◎ | ○ | △ | × |
| OCCURRENCE OF PARTICLE COAGULATION | × | × | △ | ○ | ◎ | ◎ | ◎ | ◎ | ○ | △ | × |

◎ : RAPIDLY DISSOCIATABLE COAGULATION, COMPLETELY PREVENTABLE COAGULATION

○ : DISSOCIATABLE COAGULATION PREVENTABLE COAGULATION

△ : COAGULATION DISSOCIATING EFFECT PRESENT, COAGULATION OCCURRENCE SUPPRESSED

× : NO COAGULATION DISSOCIATING EFFECT, OCCURRENCE OF COAGULATION

FIG. 21

| ALTERNATING VOLTAGE (V) | 50 | 75 | 100 | 125 | 150 | 200 | 250 | 300 | 350 | 400 | 450 |
|---|---|---|---|---|---|---|---|---|---|---|---|
| EFFECT OF PREVENTING PARTICLE-COAGULATION & EFFECT OF PREVENTING ADHESION OF PARTICLES TO GAP MEMBER | × | × | △ | ○ | ◎ | ◎ | ◎ | ◎ | ○ | △ | × |

◎:PROMINENT PREVENTION EFFECT

○:ORDINARY PREVENTION EFFECT

△:SLIGHT PREVENTION EFFECT

×:NO PREVENTION EFFECT

IMAGE DISPLAY DEVICE AND DISPLAY DRIVE METHOD

BACKGROUND OF THE INVENTION

1. Field of the Invention

The present invention relates to image display devices and display drive methods and, more particularly, to an image display device which is rewritable repeatedly and display drive method thereof.

2. Description of the Related Art

Conventionally, there have been proposed, as repeatedly rewritable display mediums, twisting ball displays (display with rotation of two-colored particles), electrophoretic display mediums, magnetophoretic display mediums, thermal-rewritable display mediums, storable liquid crystal display mediums.

Among these display mediums, the thermal-rewritable and storable liquid crystal display mediums are excellent in storing images but cannot display sufficient paper-like whiteness in the background. Therefore, in displaying images, the imaging and non-imaging regions have insufficient contrast, thus making it difficult to display a clear image.

Moreover, in the display medium utilizing electrophoresis or magnetophresis, for example, coloring particles which can move under electric or magnetic field are dispersed in a white liquid. In the imaging region, the color of coloring particles is displayed by putting the coloring particles on the display surface. In the non-imaging region, the coloring particles are removed from the display surface to display white with the white liquid. Thus, an image is formed. The coloring particles do not move unless an electric or magnetic field is applied thereto, thus making it possible to store the image displayed.

In these display mediums, white which is displayed with the white liquid is clear. However, when displaying the color of coloring particles, white liquid intrudes in the gap between coloring particles, thereby lowering the density of image. This, accordingly, lowers the contrast between the imaging region and the non-imaging region, making it difficult to display a clear image. Also, because the display medium is filled with the white liquid, when the display medium is removed from the image display apparatus and is roughly handled, the white liquid may leak out of the display medium.

Moreover, in the twisting ball display, spherical particles painted white on a half surface and black on the remaining half are rotated under the action of an electric field. Display is conducted such that, for example, in the imaging region the black surface is directed toward the display surface while in the non-imaging region the white surface is directed toward the display surface. Since the particles are not rotated if an electric-field is not applied to the particles, an image can be stored. Oil exists only in the cavity around the particles. However, because the interior of the display medium is mainly solid, the display medium is comparatively easily made in a sheet form.

In this display medium, however, it is difficult to perfectly rotate the particles. The contrast is lowered by the particles not perfectly rotated, making it difficult to form a vivid display image. Further, even if the white-painted hemisphere be perfectly directed toward the display side, it is still difficult to display paper-like white because of light absorption and scatter in the cavity region and it is difficult to display a vivid image. Furthermore, because the particles are required to have a size smaller than a size of the pixel, fine spherical particles must be produced for displaying images with high resolution, which requires high-level manufacturing technology.

Moreover, there are recent proposals, as completely-solid display medium, of the display mediums in which coloring particles, such as a powder toner, are enclosed in a space between a pair of substrates. For example, these are the display mediums described in Japan Hardcopy, '99 theses, pp. 249–252. Japan Hardcopy, '99 Fall Proceedings, pp. 10–13, JP A No. 2000-347483, and the display mediums or the like described in JP-A No. 2001-33833.

These display mediums have a structure having a conductive coloring toner (e.g., black toner) and an insulating coloring toner (e.g., white particle) in a space between a transparent front substrate and a rear substrate. Electrodes are formed on the front and rear substrates. The inner surfaces of the substrates are coated with a charge-transport material to transport only one charge polarity (e.g., holes).

If a voltage is applied to the substrates, holes are injected only to the conductive black toner. The black toner, electrified positive, moves between the substrates while pushing away the white particles according to an electric field formed between the substrates. Herein, black is displayed by moving the black toner toward the front substrate while white of the white particles is displayed by moving the black toner toward the rear substrate. Accordingly, a black and white image can be displayed by applying a voltage to the Substrate to desirably move the black toner according to image information.

The above display medium using coloring particles can store images because the particles do not move if an electric field is not applied thereto. Also, liquid spill does not occur because the display medium is solid. The use of two kinds of coloring particles (e.g., white and black particles) results in image display with high contrast.

Further, the display medium described in Japanese Patent Application No. 2000-165138 proposed by the present inventors has a structure in which two kinds of coloring particles different in color and electrifying characteristics are enclosed in a space between a transparent front substrate and a rear substrate. As the two kinds of coloring particles, particles having different polarities are selected. Consequently, if an electric field is formed between the substrates of the display medium, the two kinds of coloring particles respectively move toward the different substrates. If a voltage is applied to the substrates according to image information, a clear image with high contrast can be displayed.

However, in the display medium enclosing the coloring particles in a space between a pair of substrates, adhesion and coagulation gradually occur as images are displayed repeatedly. Thus, there has been a problem of raising defective display in a dot-like form.

Moreover, in the structure having a gap member to keep a gap between substrates and divide the space between the substrates into a plurality of cells, the particles gradually adhere onto the gap member. Thus, there have been problems in that display contrast is lowered due to a decrease in the number of particles which can actually move or defective display is caused by particles adhering to the gap member.

Also, when the display medium is disposed vertically and used as such and the coloring particles move toward the substrate according to an electric field formed between the substrates, the coloring particles move slightly downward from their previous height due to the action of gravity. Accordingly, change of display if repeated causes the coloring particles to gradually fall, ultimately causing a serious problem of impossible display.

Incidentally, in the structure having a gap member to keep a gap between the substrates and divide the space between the substrates into a plurality of cells, if the cell size is reduced, the movement of coloring particle in the gravity direction can be suppressed within a practical level. However, if the cell size is reduced, there is increase in the ratio of a gap member area to the actual display area on the display surface (area of the region enclosing coloring particles to effect actual display), resulting in lowered contrast of display.

SUMMARY OF THE INVENTION

The present invention has been made in view of the above fact, and it is a first object to provide an image display device having coloring particles in a space between a pair of substrates and display drive method thereof capable of preventing the coloring particles from coagulating even when display is repeatedly conducted, and, if the display medium comprises cells, preventing the coloring particles from adhering and coagulating onto a gap member defining the cells.

Also, a second object is to provide an image display device comprising cells formed between a pair of substrates and enclosing coloring particles and display drive method that, when the image display device is disposed vertically and used as such, coloring particles can be prevented from falling and, even if they falls, they can be restored to their initial height, thereby maintaining high display contrast, without having to reduce the size of cells compared with a conventional display medium.

In order to achieve the object, the present invention provides an image display device comprising: an image display medium having a pair of substrates, an electrode provided on each respective substrate, and a plurality of kinds of particles which are enclosed in a space between the substrates and which are movable due to an electric field formed between the electrodes and which have different colors and electrifying properties; and a voltage applying unit for applying to the electrodes an alternating voltage having a frequency to move the plurality of kinds of particles.

A plurality of kinds of particles that are different in color and electrifying characteristics are enclosed in the space between the pair of substrates of the image display medium. The pair of substrates is provided with electrodes. The electrodes may be provided on the inner surfaces of the pair of substrates, on the outer surfaces of the pair of substrates or at the inside of each substrate. By applying an electric field between the pair of electrodes, the particles different in color can be moved between the substrates depending upon the electrifying characteristic of the particles to display images. Incidentally, at least one of the pair of substrates can be made with dielectric substance such as insulating resin which is transparent, semi-transparent or colored transparent. Also, besides insulating particles, conductive, hole-transportable or electron-transportable particles can be used.

The particle involves variation in particle size or electrification amount. Due to this, variation occurs in an electrostatic drive force that the particles accept from an electric field formed between the substrates. Moreover, depending upon an adhesion state of the particles to the substrate or contact state between adjacent particles, the mobilities of particles are different under the same electric field. Accordingly, if an electric field is applied between the substrates, the easily movable particles move but the particles which can not easily move do not move and continue to adhere to the substrate or adjacent particle. Thus, the particles which can not easily move form coagulation with repeating change of display.

Consequently, the voltage applying unit applies to the electrodes an alternating voltage having a frequency to move the plurality of kinds of particles. The alternating voltage is applied as initialization (initializing drive), e.g. each time when image display is changed.

If an alternating electric field is formed between the substrates, the particles which can easily move are reciprocally moved between the substrates. By the collisions of such particles and the particles which can not easily move, the particles which can not easily move are dissociated from adhesion to the substrate or adjacent particles, and can be moved. As a result, particle coagulation is prevented. Moreover, even after already forming particle coagulation, the particles which do not coagulate are reciprocally moved and collide repeatedly against the coagulation, thereby dissociating the coagulation.

Herein, emphasis is placed on the frequency for switching the alternating electric field. The foregoing effect would not be obtained by simply applying an alternating voltage.

Consequently, it is preferred that the frequency is from 20 Hz to 20 kHz.

If the frequency of an alternating voltage is lower than 20 Hz, the particles move toward the opposite substrate under the electric field and adhere once to the substrate in a stable state, and then begin moving again toward the opposite substrate due to an electric field having the reverse direction. This is the same as the state in which display change is rapidly repeated and accelerates particle coagulation, thus rendering conspicuous the occurrence of defective display.

Moreover, if the frequency of alternating voltage is higher than 20 kHz, the movement of particles can not follow the switch rate of electric field, thus extremely lowering the particle moving amount. Thus, the foregoing particle coagulation preventing effect due to collisions cannot be obtained. Furthermore, the particles having less momentum tend to form coagulation.

Accordingly, the frequency of an alternating voltage applied to the substrates is to be set such that the particles favorably, reciprocally move continuously between the substrates. Thus, it is preferred that the frequency is from 20 Hz to 20 kHz.

An initializing drive voltage to form an alternating electric field between the substrates may be applied to the substrates before or after the application of a display drive voltage for image display. However, where display is not conducted for a long time, it is preferred to conduct initialization before applying a display drive voltage. This is because the electrifying amount of some particles slightly decline and the initialization before display also provides the effect that the particle electrifying amount is restored due to frictional electrification by collision between the particles or the particle and the substrate.

Moreover, the initializing drive voltage may be applied simultaneously to all electrodes or to respective electrodes. However, the initializing drive voltage is preferably applied simultaneously to all electrodes. This is because, if a voltage for forming an alternating electric field is applied to some electrodes of the image display medium, the particles between the voltage-applied electrodes which reciprocally move also moves in a direction other than voltage-applied direction and particles may be localize in the image display medium. The simultaneous initialization of all electrodes enables uniform initialization of the display surface.

It is preferred that the image display medium further comprises a gap member for holding the pair of substrates with a predetermined gap and dividing a space between the pair of substrates into a plurality of cells and that the voltage applying unit applies the alternating voltage per each of the cells.

In this manner, when the image display medium has a plurality of cells divided by the gap member, some particles may adhere to the gap member. However, by applying a predetermined alternating voltage to the electrodes as described above, particle coagulation can be prevented and further the particles which adhere to the gap member can be effectively detached therefrom by mechanical collision between the particles reciprocally moving at a high speed.

Incidentally, if the frequency for switching alternating electric field is lower than 20 Hz or exceeds 20 kHz, the particle coagulation preventing effect due to particle collision cannot be obtained and the particles remarkably adhere to the gap member defining the cells as described above.

Moreover, the initializing drive voltage may be applied simultaneously to all electrodes or sequentially to respective electrodes or respective cells. It is however preferred to carry out simultaneous initialization of at least one cell. This is because when, for example, a plurality of electrodes correspond to one cell and an alternating electric voltage is applied to some electrodes within the cell, the particles between the voltage-applied electrodes which reciprocally move also move in a direction other than a voltage-applied direction and particles may localize within the cell. Contrary to this, initialization of at least one cell ensures a uniform initialization within the cell and in turn uniform initialization of the entire display surface.

Furthermore, when an image display medium comprises the electrodes respectively formed on the pair of substrates each of which corresponds to each pixel and to each cell, if initialization is conducted based on the electrode corresponding to each cell, initializing drive voltage can be combined with display drive voltage into one drive voltage thus eliminating the necessity to especially provide a initialization sequence. Also, eliminated is flicker on the display surface as observed when applying initializing voltage simultaneously to the entire display surface. Thus, change of display can be carried out continuously.

When inclining the image display medium with respect to a horizontal direction, it is preferred that the frequency is from 50 Hz to 10 kHz.

The present inventors confirmed that when the image display medium is inclined (e.g., vertically disposed) to repeatedly display images and a high-frequency alternating electric field is applied to the image display medium in a state where the coloring particles have fallen due to gravity, the coloring particles that have fallen and are deposited at the bottom are diffused upward to a certain constant height to thereby restore a display state. It was also confirmed that, by applying a high-frequency alternating electric field at a proper interval during successive display on the vertically disposed image display medium, falling coloring particles can be halted at a certain constant height thereby maintaining the height of display.

Herein, emphasis is placed still on the frequency for switching alternating electric field. The above particle diffusion effect is obtainable at a frequency for alternating electric field of from 20 Hz to 20 kHz. However, the effective effect is obtainable at from 50 Hz to 10 kHz. Particularly, it is preferred to set it at from 100 Hz to 3 kHz. In this case, the display height when applying a high-frequency alternating electric field for initialization (height of the uppermost particle from the lower most of the image display medium) can be from several times to 10–20 times as high as the display height when no alternating electric field is acted upon. Accordingly, when using the display medium such that it is inclined relative to the horizontal direction, the application of an alternating electric field based on that frequency range can effectively prevent localization of the particle due to gravity, Moreover, if the cells are set to a size that the particle is to be diffused by applying a high-frequency alternating electric field, the particles can be completely prevented from falling even if the image display medium is disposed vertically and used. In this case, by applying as initialization a high-frequency alternating electric field, the cell size can be from several times to tens times as large as that of the conventional scheme. Accordingly, it is possible to achieve high contrast free from lowering of the contrast due to scale-down of the cell, even if the image display medium is disposed vertically and used.

Moreover, the initialization is not necessarily conducted each time when image is changed. The voltage applying unit may apply the alternating voltage to the electrodes every several times that image display medium is switched.

Namely, particles gradually coagulate, adhere to the gap member, and fall due to gravity as images are changed. These phenomena would not be recognized as defective display, if the number of change of images is from several to tens times. Accordingly, alternating voltage is applied, e.g. once per several to tens of changes of images. By thus carrying out initialization prior to recognition of defective display, it is possible to prevent defective display from being recognized.

Moreover, because initialization utilizes a mechanical collision force due to particle reciprocating motion, deformation of the particles or wear of the substrate surface due to the collisions between the particles or between the particle and the substrate may occur. Also, mechanical or characteristic change in the particle or substrate due to the above or deterioration in the display characteristics resulting from them may occur.

Accordingly, initialization is preferably suppressed to the minimum degree. If initialization is once per a plurality of changes of images, the deterioration of the image display medium can be suppressed to the minimum degree.

Moreover, the voltage applying unit may apply to the electrodes an alternating voltage lower than a display drive voltage for displaying images on the image displaying medium.

This is because initialization utilizes mechanical collision force due to particle reciprocating motion as described above and this may result in the deterioration of the image display medium.

During initialization, because the particles readily moves by mechanical collision of the reciprocally moving particles due to an alternating electric field, initialization can be carried out favorably even if the voltage is lower than a display drive voltage for image display. In this manner, by applying to the pair of electrodes an alternating voltage lower than the display drive voltage for image display on the image display medium, reduced is the collision force between the particles or between the particle and the substrate during initialization, thereby making it possible to further reduce the deterioration of the image display medium due to initialization.

Moreover, when the image display medium is disposed vertically and used, the voltage applying unit may apply to the electrodes an alternating voltage higher than a display drive voltage for displaying images on the image displaying medium.

Namely, if the initializing drive voltage is higher than the display drive voltage for image display, a greater collision force is obtained. Accordingly, when the image display medium is inclined in relation to a horizontal direction, an alternating voltage higher than the display drive voltage is applied to the electrodes. Because this can diffuse the particles upward, the particles can be prevented more effectively from depositing in the lower region of the medium due to the action of gravity.

However, the deterioration in the image display medium may be accelerated because the particle collision force increase by raising the initializing drive force. Accordingly, initialization is preferably carried out once per a plurality of changes of images.

The voltage applying unit may apply to the electrodes, at a predetermined ratio, an alternating voltage equal to or lower than the display drive voltage and an alternating voltage higher than the display drive voltage.

For example, initialization is basically carried out with the alternating voltage lower than the display drive voltage, to conduct initialization with the alternating voltage higher than the display drive voltage every several times. This can effectively prevent the occurrence of particle coagulation and adhesion of the particles to the gap member and also suppress to some extent the deterioration in the image display medium due to initialization. Thus, further effectively secured is a larger cell even if the image display medium is disposed vertically and used.

Also, the voltage applying unit may apply to the pair of substrates an alternating voltage superposed with a predetermined direct current voltage on the alternating voltage.

Namely, electrifying amount of the particles and adhesive force of the particles to the substrate, etc, are different depending on the components and the constitution of the particles, and the mobility of particles is different depending on the kind thereof. Accordingly, by superposing a direct current voltage on the alternating voltage, the intensity of applying alternating voltage is matched to the mobility of particles to be used. This provides further stable initialization.

Moreover, the voltage applying unit may include a changing unit for changing a duty of the alternating voltage.

In this manner, by properly changing the duty in accordance with the type of the particles, obtained is the effect similar to the above.

The present invention also provides a display drive method for an image display medium having a pair of substrates, an electrode provided on each substrate respectively, and a plurality of kinds of particles which are enclosed in a space between the substrates and which are movable due to an electric field formed between the electrodes and which have different color and electrifying properties. The display drive method comprises applying to the electrodes an alternating voltage having a frequency to move the plurality of kinds of particles.

This can prevent particle coagulation and allow images with high contrast to be displayed.

Incidentally, the above process can be implemented with a program for executing a process to apply an alternating voltage for moving the plurality of kinds of particles to the electrodes of an image display medium having a pair of substrates, electrode provided on each respective substrate, and a plurality of kinds of particles which are enclosed in a space between the pair of substrates and which can move due to an electric field formed between the electrodes and which have different color and electrifying properties. Moreover, the program may be recorded in a recording medium to be read by the computer.

BRIEF DESCRIPTION OF THE DRAWINGS

FIG. 8 is a view for explaining a frequency of a voltage applied to the image display medium, occurrence of particle coagulation and dissociation effect;

FIG. 21 is a figure for explaining an alternating voltage, an effect of preventing particle-coagulation and an effect of preventing adhesion of particles to the gap member;

DETAILED DESCRIPTION OF THE PREFERRED EMBODIMENTS

Figure 1:
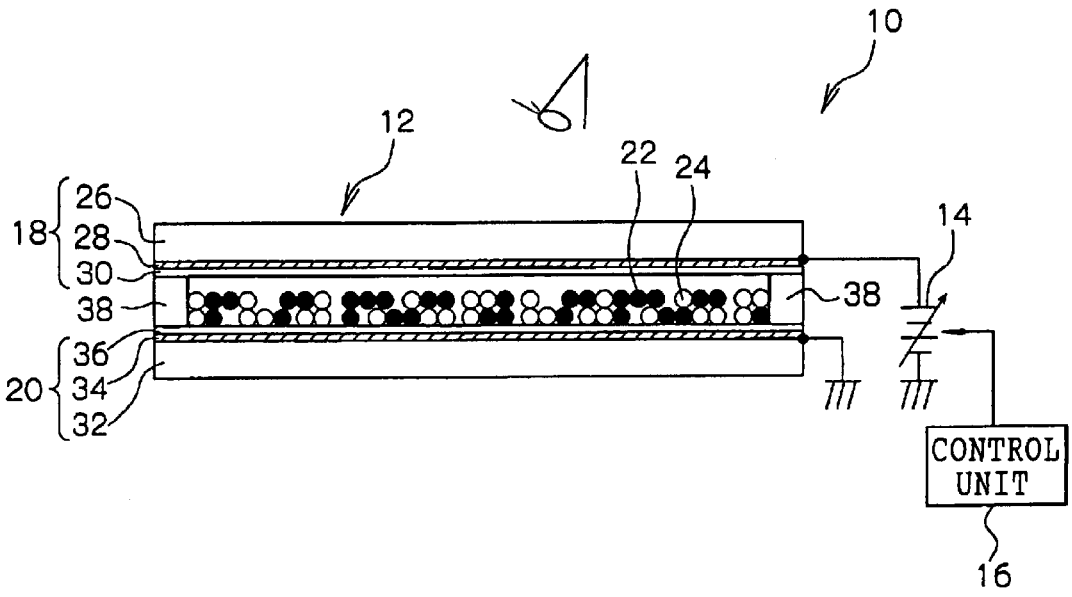
FIG. 1 is a schematic structural view of an image display device according to a first embodiment.

Explanation will be made on a fist embodiment of the present invention. FIG. 1 shows a schematic structure of an image display apparatus 10.

An image display device 10 has an image display medium 12, a voltage applying unit 14 and a control unit 16. In the image display medium 12, black particles 22 and white particles 24 are enclosed in a space between a transparent front substrate 18 and a rear substrate 20.

In the front substrate 18, a substrate 26, an electrode 28 and a surface coat layer 30 are laminated. The electrode 28 is made with a transparent electrode material. In the rear substrate 20, a substrate 32, an electrode 34 and a surface coat layer 36 are laminated.

The electrode 28 of the front substrate 18 is connected to the voltage applying unit 14 while the electrode 34 of the rear substrate 20 is grounded. The voltage applying unit 14 is connected to a control unit 16. The control unit 16 includes a not-shown CPU, RAM, ROM and so on.

The substrates 26, 32 correspond to a pair of substrates of the invention, the electrodes 26, 34 to electrode provided on each respective substrate, and the black particles 22 and the white particles 24 to a plurality of kinds of particles, and the voltage applying unit 14 to the voltage applying unit of the invention.

The voltage applying unit 14 applies a direct-current voltage having a voltage value designated from the control unit 16 or an alternating voltage having a frequency and voltage value designated therefrom to the electrode 28.

The voltage applying unit 14 applies a predetermined voltage to the electrode 28 due to an instruction of the control unit 16, to move the black particles 22 and the white particles 24 respectively toward the front substrate 18 or the rear substrate 20. An image can be displayed by making the electrode 28 and electrode 34, for example, in a simple matrix or active-matrix structure and applying a voltage to various parts depending on an image to be displayed. Also, an image can also be displayed by arranging a plurality of image display media 12 each having one pixel and making each pixel display black or white.

The substrate 26 and electrode 28 of the front substrate 18 may be a 7059-glass substrate which has transparent ITO electrode and which has 50 mm×50 mm×1.1 mm (length×width×thickness). The surface of the ITO glass substrate which surface contacts the particles (ITO electrode side) can be coated with a surface coat layer 30 by applying a transparent polycarbonate resin (Mitsubishi Gas Chemical, PC-Z) in a thickness of about 5 μm.

Moreover, the substrate 32 and electrode 34 of the rear substrate 20 may be an epoxy substrate having 50 mm×50 mm×3 mm length×width×thickness) on which a copper thin film is formed. Also, the surface of the epoxy substrate which surface contacts the particles (copper thin film side) can be coated with a surface coat layer 36 by applying polycarbonate resin in a thickness of about 5 μm.

A gap member 38 is disposed between the front substrate and the rear substrate 20 to maintain a predetermined gap. The gap member 38 may be a silicone rubber sheet which has 50 mm×50 mm×0.3 mm (length×width×thickness) and which has opening of 40 mm×40 mm in the center thereof.

The black particles 22 can be made, for example, by mixing spherical black particles which are made of cross-linked polymethyl methacrylate containing carbon and which have a volume average particle size of 20 μm (Techpolmer-MBX-Black, by Sekisui Fine Chemical), and an aerosil A130 fine particles treated with aminopropyl trimethoxy silane, in a weight ratio of 100:0.2. The white particles 24 may be made by mixing a spherical white particles which are made of cross-linked polymethyl methacrylate containing titanum oxide and which have a volume average particle size of 20 μm (Techpolmer-MBX-White by Sekisui Fine Chemical), and titania fine powders treated with isopropyl trimethoxy silane, in a weight ratio of 100:1. It is possible to use a mixture of these black and white particles in a weight ratio of 1:2. In this case, the black particles 22 and white particles 24 are electrified by friction. Charges of black and white particles were measured by the charge spectrograph method after mixing them, the black particles 22 had a charge distribution whose average charge was about 15 fC while white particles 24 had a charge distribution whose average charge was about −15 fC. Namely, the black particles 22 were to be electrified positive while the white particles 24 negative.

Moreover, about 100 mg of the mixture of the black particles 22 and white particles 24 were evenly sifted through a screen and put into the rectangular parallelopiped opening of the gap member 38 disposed on the rear substrate 20. The total volumetric ratio of the black particles 22 and white particles 24 to a gap between the substrates (volume of the space (opening) of the gap member 38 disposed on the rear substrate 20) was approximately 15%. An image display medium 12 can be formed by putting the front substrate 18 on the gap member 38 disposed on the rear substrate 20 and then holding the both substrates under pressure by the use of a double-clip to make the gap member 38 closely contact with the both substrates.

Next, explanation is made on a method for driving the image display medium 12.

Figure 2:
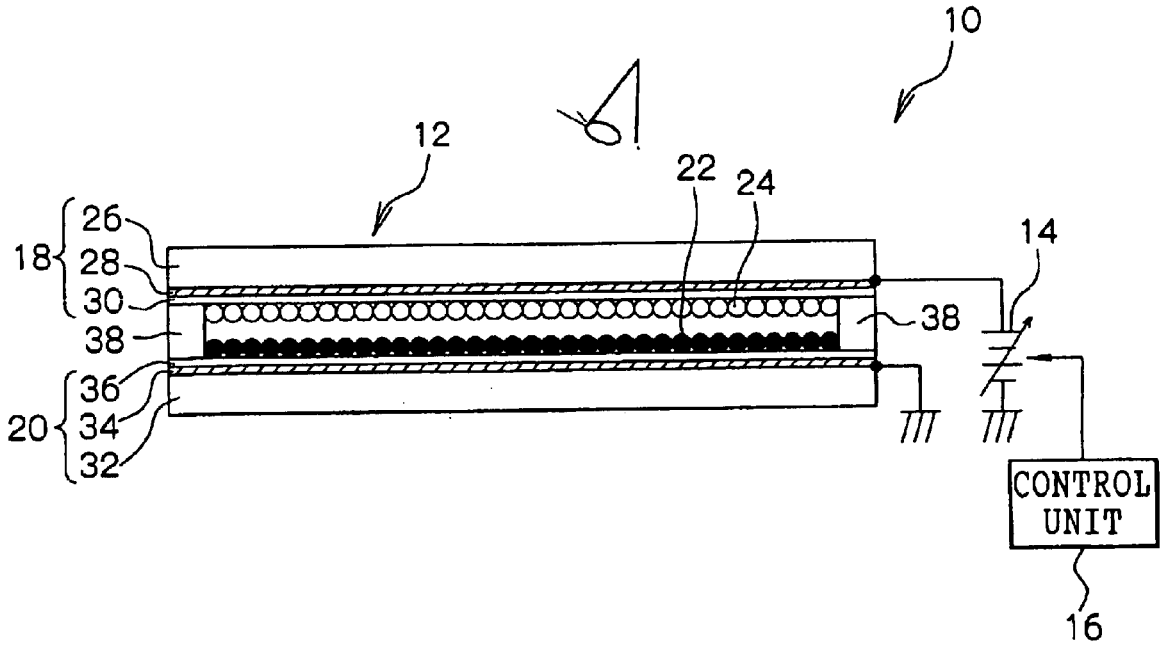
FIG. 2 is a view showing a state that white is displayed on an image display medium.

When a direct-current voltage of +300V, for example, is applied to the electrode 28 of the front substrate 18 by the voltage applying unit 14 according to an instruction of the control unit 16, the white particles 24 electrified negative move toward the front substrate 18 under the action of electric field while the black particles 22 electrified positive move toward the rear substrate 20 as shown in FIG. 2. Thus white screen can be favorably formed. In this state, even if the voltage applied to the front substrate 18 is rendered 0, the white particles 24 put on the front substrate 18 do not fall, and there is no change in density of the screen. It is considered that the coloring particles on the substrate are held by an image force and van-der-Waals force even where the electric field is put off.

Figure 3:
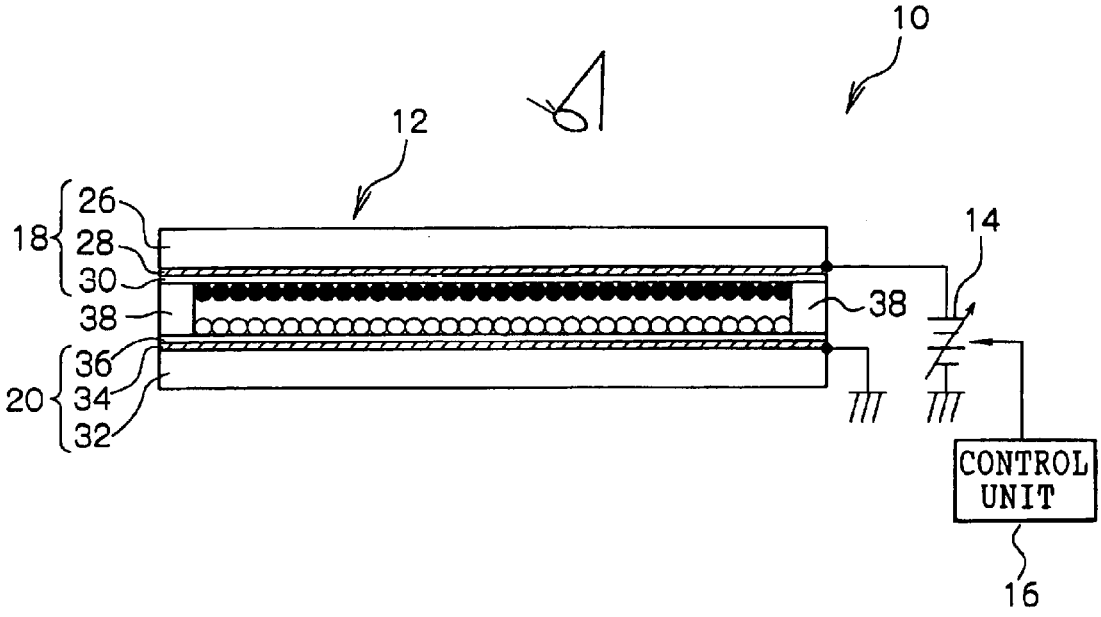
FIG. 3 is a view showing a state that black is displayed on an image display medium.

Next, when a direct-current voltage of −300V, for example, is applied to the electrode 28 of the front substrate 18 by the voltage applying unit 14 according to an instruction of the control unit 16, the white particles 24 put on the front substrate 18 move toward the rear substrate 20 while the black particles 22 put on the rear substrate 20 move toward the front substrate 18, as shown in FIG. 3. Thus, black screen can be favorably formed. Herein, even if the voltage applied to the front substrate 18 is rendered 0, the black particles 22 on the front substrate 18 do not fall, and there is no change in density of the screen.

Figure 4:
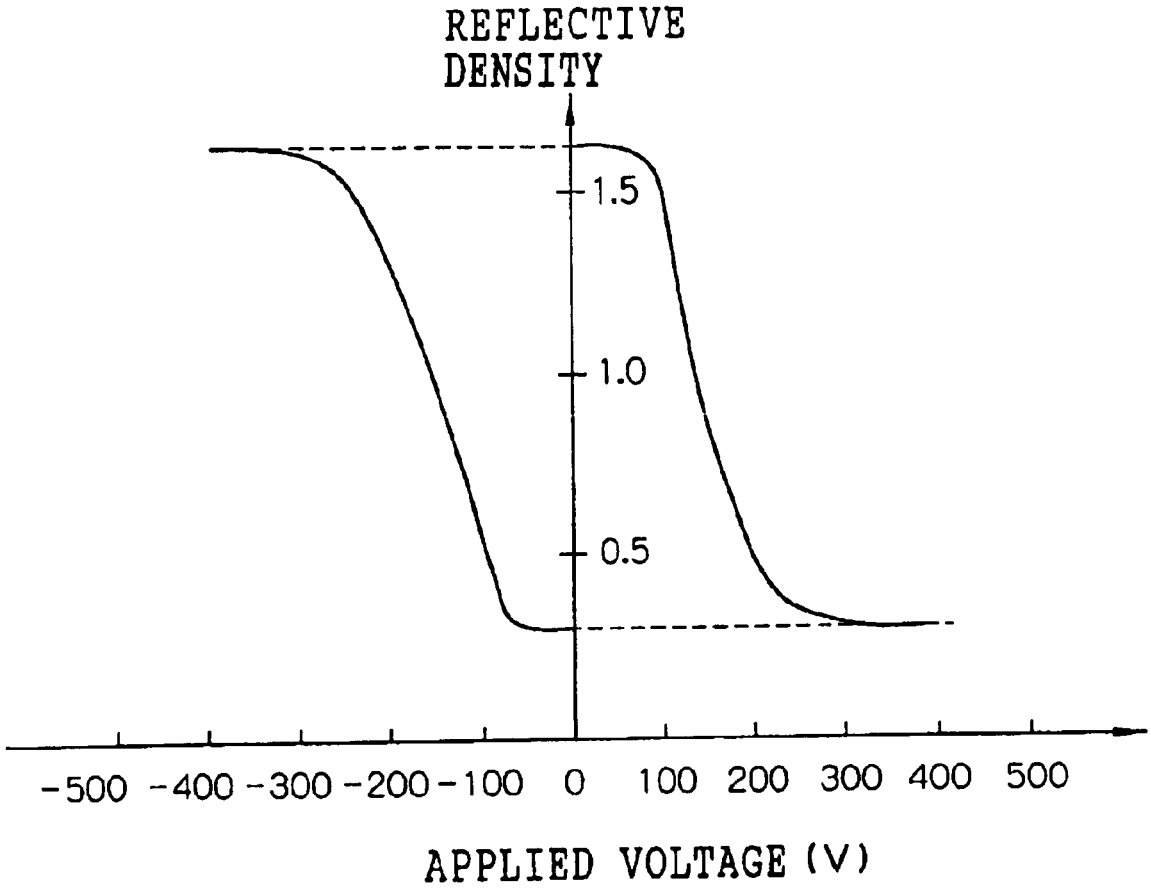
FIG. 4 is a graph showing a relationship between a reflective density and a voltage applied to the image display medium.

FIG. 4 shows a relationship between density of an image and a voltage applied to the electrode 28 of the front substrate 18 Herein, the density was measured by a reflection densitometer (X-Rite404 available from X-Rite). The measuring method included, first, the application of a +400V pulse voltage to the electrode 28 of the front substrate 18 of the image display medium 12 for 30 msec., to display white on the surface of the front substrate 18. Then, a negative pulse voltage was applied to the electrode 28 of the front substrate 18 for 30 msec., and then a density on the front-substrate surface was measured by the reflection density meter. Thereafter, +400V voltage was again applied to the electrode 28 of the front substrate 18 for 30 msec., to again display white on the surface of the front substrate 18. The above process was repeated while gradually changing the value of the negative pulse voltage applied between −400V and 0V.

Also, −400V voltage was applied to the electrode 28 of the front substrate 18 for 30 msec. similarly to the above, to display black on the surface of the front substrate 18 of prior to change of display. Then, a positive pulse voltage was applied to the electrode 28 of the front substrate 18 for 30 msec., and then a density on the surface of the front substrate 18 was measured by the reflection densitometer. Thereafter, −400V voltage was again applied to the electrode 28 of the front substrate 18 for 30 msec., to again display black on the surface of the front substrate 18. The above process was repeated while gradually changing the value of applied positive pulse voltage between 0V and +400V.

As apparent from FIG. 4, it is seen that density of the screen, in both black and white display, nearly saturates at an application voltage of ±300V. The density of the screen in this case is about 1.6 for black and about 0.3 for white. It can be seen that images with high contrast can be displayed.

Figure 5:
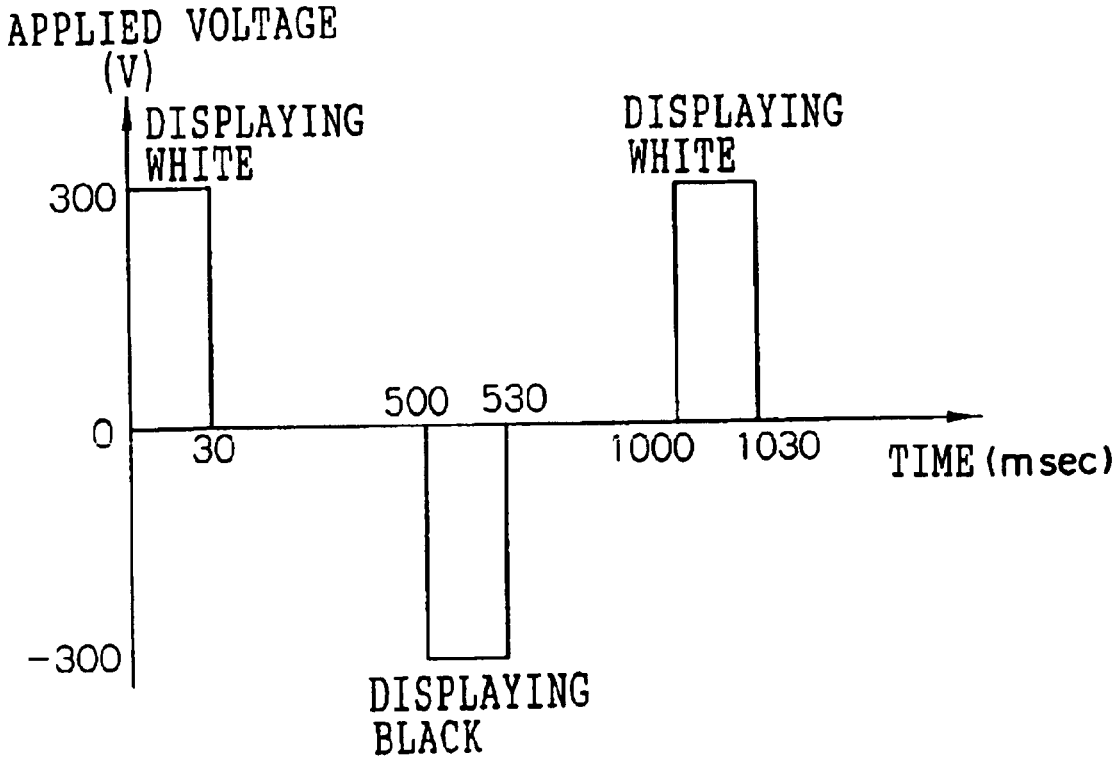
FIG. 5 is a view for explaining a method for applying voltage to the image display medium.
Figure 6:
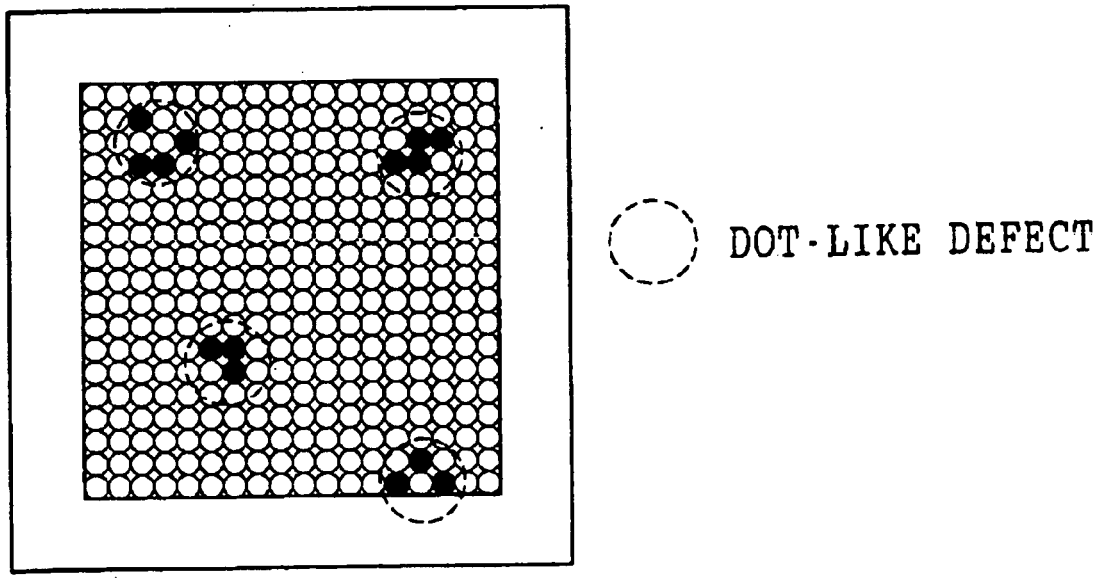
FIG. 6 is a view for explaining dot-like defects.
Figure 7:
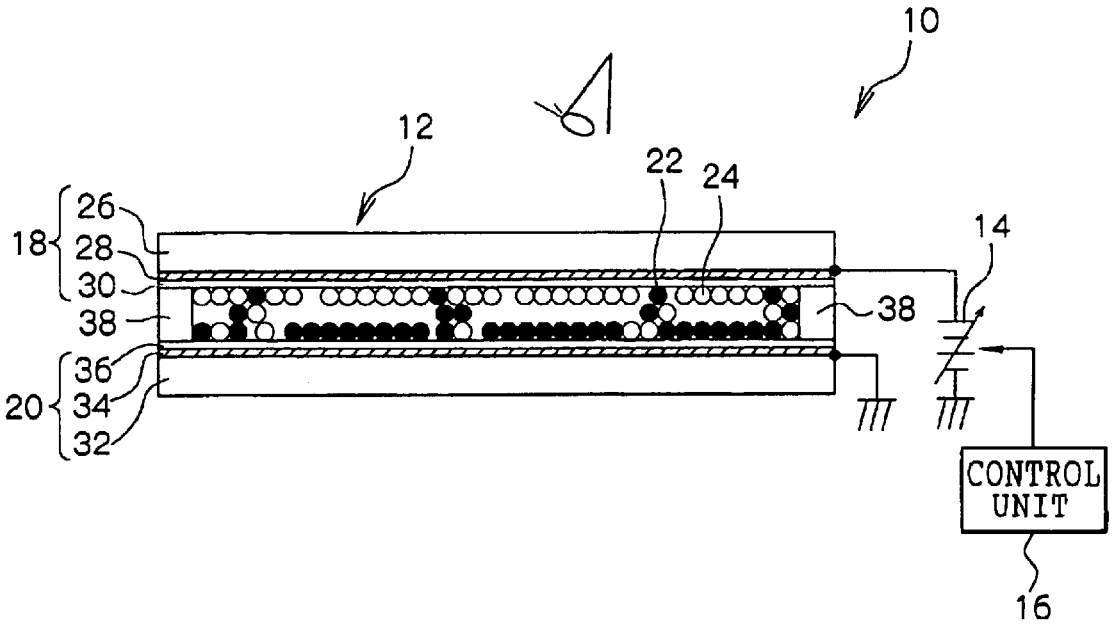
FIG. 7 is a view showing a state of particle coagulation occurred in the image display medium.

Next, a pulse voltage having a voltage of ±300V and application time of 30 msec. was applied, alternately with an interval of 0.5 sec., to the electrode 28 of the front substrate 18 of the image display medium 12, as shown in FIG. 5. Thereupon, it was confirmed that coloring-particle coagulation occurred when the number of times of change of images exceeded several tens, when the changing of the images was further repeated, clear dot-like defects occurred during displaying white as viewed from the front substrate 18, as shown in FIG. 6. At this time, the black particles 22 and white particles 24 between the substrate were in a state as shown in FIG. 7, wherein particle coagulation was confirmed.

In this state, a ±300V alternating voltage was applied to the electrode 28 of the front substrate 18 of the image display medium 12 while gradually changing the frequency, thus confirming a dissociation of coagulation. As clear from the result of FIG. 8, when the frequency of alternating voltage was lower than 20 Hz, dissociation of coagulation was not observed and the coagulation proceeded. However, when the alternating voltage was raised to 20 Hz or higher, gradual dissociation of coagulation was observed. When the frequency was further raised to 50 Hz, coagulation dissociated considerably rapidly. When the frequency was further raised up to 2 kHz, coagulation dissociated favorably. However, when raised to 10 kHz, there was dissociation effect of coagulation but the effect was lowered. After exceeding 20 kHz, particles hardly moved, making it impossible to dissociate the coagulation. Conversely, new coagulation of particles occurred at the other points. This is because the movement of particles cannot follow the switching of the voltage if the frequency is excessively high, so that the particles come to a virtual standstill.

Figure 9:
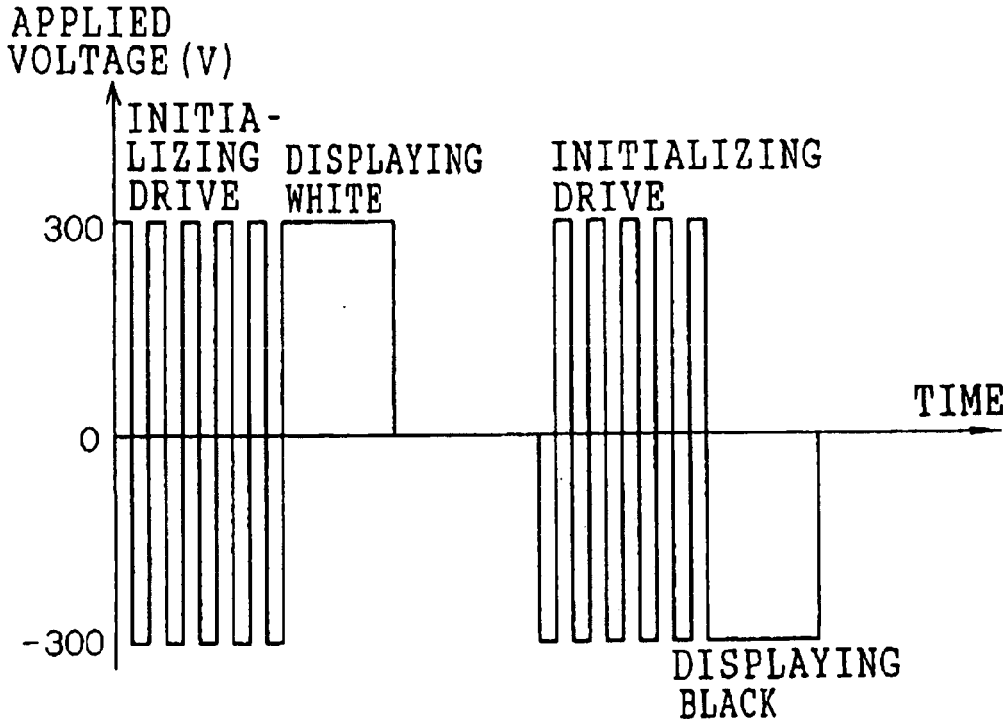
FIG. 9 is a view for explaining a method for applying voltage to the image display medium.

Next, an alternating voltage having a voltage of ±300V and frequency of 1 kHz was applied, for initialization, to the electrode 28 of the front substrate 18 of the image display medium 12, thereby forming a preferred display state. A pulse voltage having a voltage of ±300V and time of 30 msec. was repeatedly applied at an interval of 0.5 sec. to the electrode 28 of the front substrate 18 of the image display medium 12, to perform change of an image, and initialization was conducted each time when an image is changed. The initializing drive voltage was kept constant at ±300V and the frequency of the alternating voltage was gradually varied. In addition, the time the initializing drive voltage was applied was varied depending on the frequency such that the alternating voltage was changed 10 times as shown in FIG. 9.

As shown in FIG. 8, when the frequency of alternating voltage was lower than 20 Hz, coagulation of particles conversely occurred conspicuously. As the alternating voltage was raised to 20 Hz and over, the occurrence of coagulation became not noticeable. When the frequency was further raised to 50 Hz, occurrence of coagulation was not observed. As the frequency was further raised up to 2 kHz, occurrence of coagulation was not observed. However, when the frequency was raised to 10 kHz, small coagulation was observed. When it exceeded 20 kHz, the particles during initialization drive hardly moved, whereby coagulation could not effectively be prevented.

Figure 10:
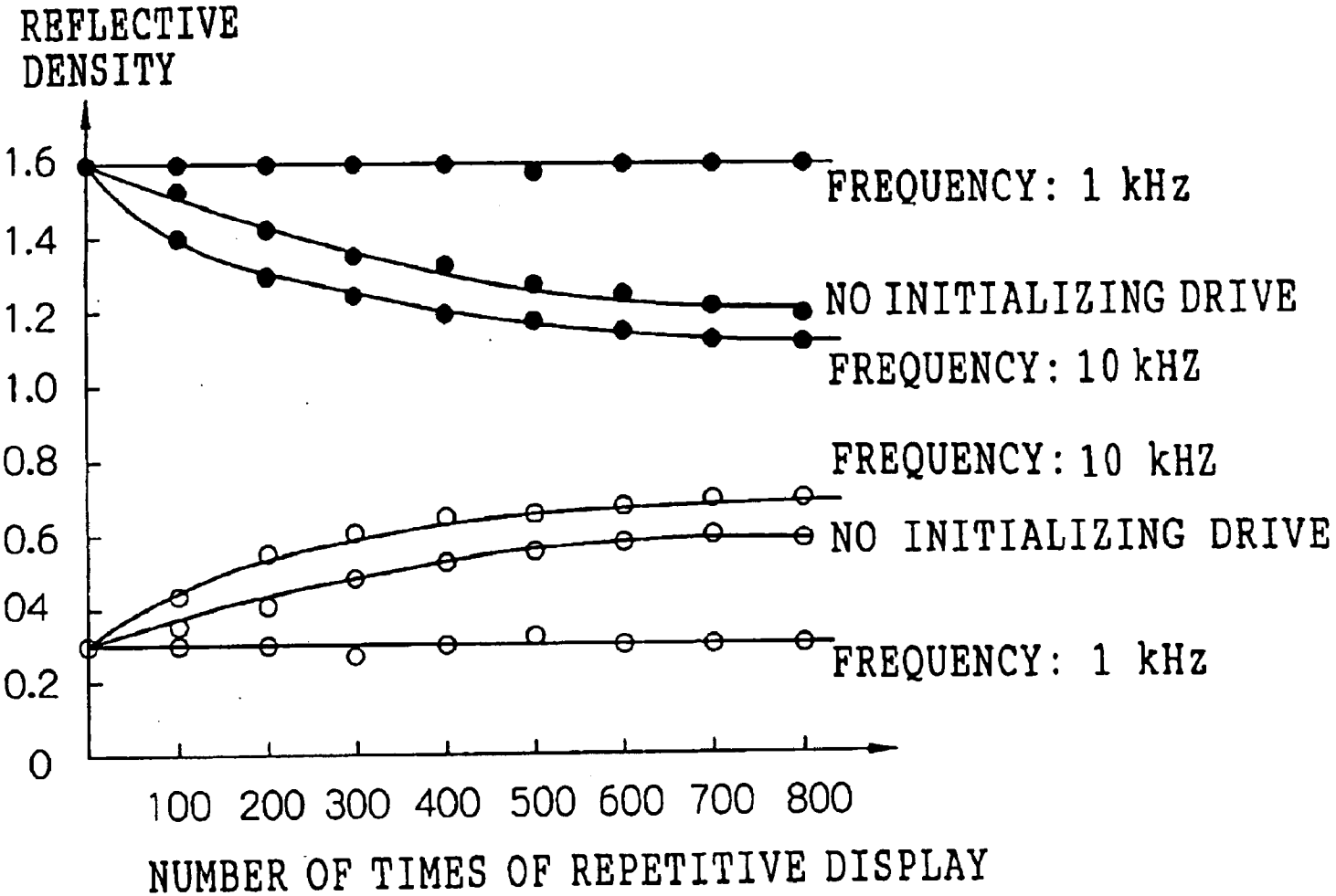
FIG. 10 is a diagram showing a relationship between a reflective density and the number of times of change of images.

FIG. 10 shows, as one example, a display density characteristic when changing of the display is repeated without performing initialization, a display density characteristic when applying an alternating voltage having frequency of 10 Hz as an initializing drive voltage, and a display density characteristic when applying an alternating voltage having a frequency of 1 kHz as an initializing drive voltage.

In the case of no initialization, defective of display occurred due to particle coagulation. Also, as the particle coagulation increases, the number of particles which can move substantially is decreased, thereby lowering contrast of display. When an alternating voltage having a frequency of 10 Hz was applied as an initializing drive voltage, coagulation remarkably occurred with conspicuous decrease in display contrast. On the contrary, where an alternating voltage having a frequency of 1 kHz was applied as an initializing drive voltage, occurrence of coagulation was not observed, thus maintaining high display contrast.

Figure 11:
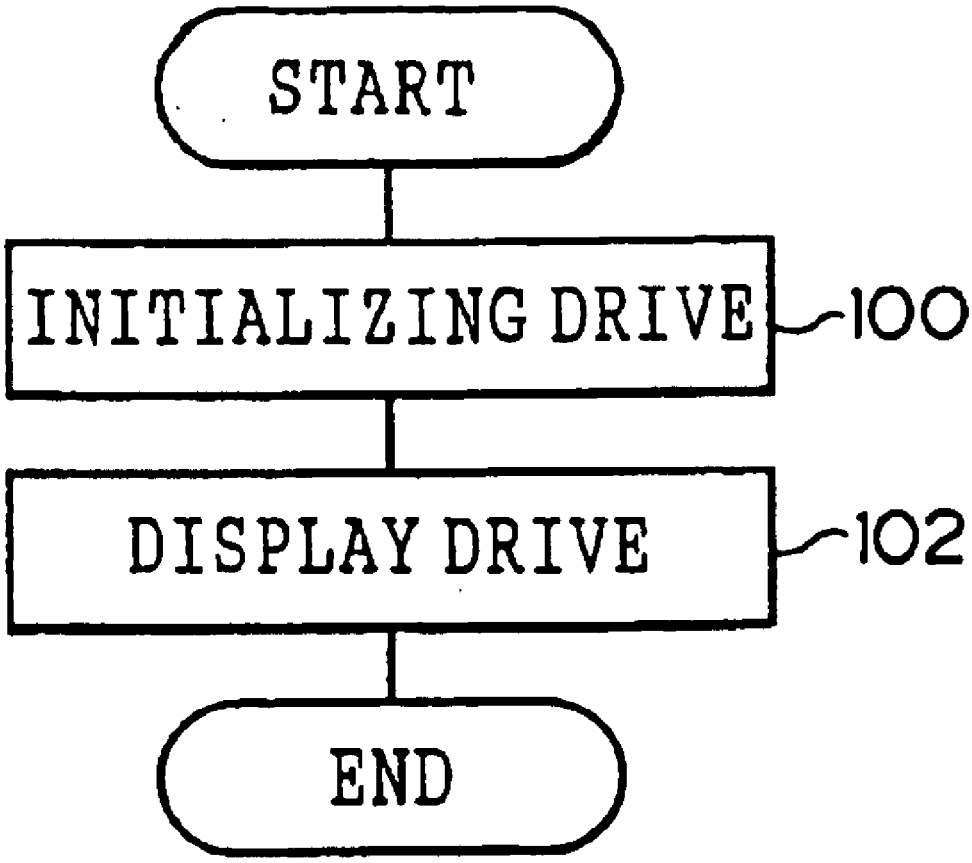
FIG. 11 is a flowchart of a control routine to be executed in a control unit.

Next, explanation is made on a control program to be executed in the control unit 16 with reference to the flowchart shown in FIG. 11. This control program is previously stored in a not-shown ROM of the control unit 16.

In step of FIG. 11, initialization of the image display medium is conducted. Specifically, the voltage applying device 14 is made to apply an alternating voltage having a predetermined frequency (e.g. 1 kHz) and predetermined voltage (e.g. ±300V) to the electrode 28, making it possible to suppress the occurrence of particle coagulation and to dissociate of particle coagulation.

In the next step 102, an image is displayed. Specifically, a predetermined direct current voltage (e.g. +300V or −300V) is applied to the electrode 28 in accordance with an image data. This allows the particle to move, enabling image display. At this time, because, prior to image display, initialization has been conducted to dissociate particle coagulation, an image with no defects and with high contrast can be displayed.

Note that the control program may be read, for execution, out of a recording medium, such as a CD-ROM.

Next, explanation is made on the coloring particles and substrate to be used in the present embodiment.

At first, the particles usable in this embodiment include, besides the foregoing particles, insulative metal oxide particles such as glass bead, alumina and titanium oxide, thermoplastic or thermosetting resin particles, those fixing coloring agent on these resin particles, and particle containing insulative coloring agent in thermoplastic or thermosetting resin.

Examples of the thermoplastic resin to be used in manufacturing colored particles include homopolymer or copolymer of styrenes, such as styrene and chlorostyrene, monoolefin such as ethylene, propylene, buthylene and isoprene, vinyl ester such as vinyl acetate, vinyl propionate, vinyl benzoate and vinyl butyrate, α-methylene aliphatic monocarboxylates such as methyl acrylate, ethyl acrylate, buthyl acrylate, dodecyl acrylate, octyl acrylate, phenyl acrylate, methyl methacrylate, ethyl methacrylate, butyl methacrylate and dodecyl methacrylate, vinyl ethers such as vinyl methyl ether, vinyl ethyl ether and vinyl buthyl ether, vinyl ketones such as vinyl methyl ketone, vinyl hexyl ketone and vinyl isopropenyl ketone.

Also, examples of the thermosetting resin to be used in manufacturing particles include crosslinked resin such as crosslinked copolymer whose main monomer is divinylbenzene and crosslinked polymethyl methacrylate, phenol resin, urea resin, melamine resin, polyester resin, silicone resin and so on. Particularly, representative examples of the binder resin include polystyrene, styrene-alkyl acrylate copolymer, styrene-alkyl methacrylate copolymer, styrene-acrylonitrile copolymer, styrene-butadiene copolymer, styrene-maleic anhydride copolymer, polyethylene, polypropylene, polyester, polyurethane, epoxy resin, silicone resin, polyamide, denatured rosin, paraffin wax and so on.

Examples of the coloring agent include organic or inorganic pigment, oil-soluble dye or the like. Known coloring agent can be used including magnetic powder such as of magnetite or ferrite, carbonblack, titanium oxide, magnesium oxide, zinc oxide, copper phthalocyanine cyan coloring material, azo yellow coloring material, azo magenta coloring material, quinacridone magenta coloring material, red coloring material, green coloring material, blue coloring material. Specifically, aniline blue, chalcoil blue, chrome yellow, ultramarine blue, Du pont oilred, quinoline yellow, methylene blue chloride, phthalocyanine blue, malachite green oxalato, lamp black, rose bengal, C.I. pigment red 48:1, C.I. pigment red 122, C.I. pigment red 57:1, C.I. pigment yellow 97, C.I. pigment blue 15:1, C.I. pigment blue 15:3 or the like can be used. Also, air-contained porous sponge-like particles and hollow particles can be used as white particles. These are selected such that two kinds of particles are different in color tone.

Although the shape of coloring particles is not especially limited, preferred is spherical particles because of small physical adhesion force of the particles to the substrate and favorable particle flowability. For forming spherical particles, it is possible to use suspension polymerization, emulsion polymerization, dispersion polymerization or the like.

The primary particle size of coloring particles, generally, is 1–1000 μm, preferably 5–50 μm. However, this is not limitative. In order to obtain high contrast, it is preferred that particle diameters of the two kinds of particles are nearly the same. This can avoid the situation that the larger particles are surrounded by the smaller particles to lower the inherent color density of the larger particle.

An external additive can be added to the surface of the coloring particles as required. The external additive makes it possible to control the electrification characteristic of the coloring particles or improve the flowability. The color of external additive is preferably white or transparent not to have an effect upon particle color.

Examples of the external additive include inorganic particles of metal oxide or the like, such as silicon oxide (silica), titanium oxide and alumina. In order to adjust the electrification properties, flowability, environment-dependency of fine particles, these can be surface-treated by a coupling agent or silicone oil.

Examples of the coupling agent include those having positive electrification nature, such as aminosilane coupling agent, aminotitanium coupling agent and nitril coupling agent and those having negative electrification nature, such as nitrogen-free (composed of atoms other than nitrogen) silane coupling agent, titanium coupling agent, epoxy silane coupling agent and acrylsilane coupling agent. Similarly, examples of the silicone oil include those having positive electrification nature, such as amino-denatured silicone oil, and those having negative electrification nature, such as dimethyl silicone oil, alkyl-denatured silicone oil, α-methyl sulfone-denatured silicone oil, methylphenyl silicone oil, chlorphenyl silicone oil and fluorine-denatured silicone oil. These are selected depending on a desired resistance of the external additive.

Among such external additives, it is preferred to use known hydrophobic silica or hydrophobic titanium oxide. In particular, well suited is a titanium compound obtained by the reaction of $TiO(OH)_2$ and silane compound, such as silane coupling agent, as described in JP A 10-3177. As the silane compound, any type of chloro silane, alkoxy silane, silazane and special silylating agent. The titanium compound is prepared by reacting $TiO(OH)_2$ prepared in a wet process with a silane compound or silicone oil, followed by drying. Because of not passing a sinter process at several hundred degrees, strong bond between Ti atoms is not formed and there is no coagulation and the fine particle is nearly in a primary particle state. Furthermore, because $TiO(OH)_2$ is directly reacted with silane compound or silicone oil, the processing amount of silane compound or silicone oil can be increased. By adjusting the processing amount of silane compound or the like, the electrification characteristics can be controlled. Electrification performance can be significantly improved compared with that of titanium oxide.

Although the primary particle size of external additive generally is 5–100 nm, preferably 10–50 nm, this is not limitative.

The blending ratio of external additive to particles is properly adjusted in view of particle size and external additive size. If the external additive is used in an excessive amount, some external additive liberates from the particle surface. The liberating external additive adheres to the surface of another particle, thereby a desired electrification properties may not be obtained. Generally, the amount of external additive is 0.01–3 parts by weight, preferably 0.05–1 part by weight relative to 100 parts by weight of particles.

In order to obtain a desired electrification properties, selected is a composition of particles, blending ratio of particles, presence or absence of external additive and composition of external additive.

External additive may be added to only one of the two kinds of particles or to both of the particles. When adding external additives to the both particles, it is preferred to use different additives which have different polarities.

Moreover, when external additives are added to the surfaces of both particles, it is preferable to drive an external additive to the particle surface by an impact force or to firmly fix the external additive on the particle surface by heating the particle surface. This can prevent the external additives from coming off of the particles, prevent external additives having different polarities from firmly coagulating into a coagulation that is difficult to dissociate by an electric field, and ultimately prevent image deterioration.

Contrast relies upon particle sizes of the two kinds of particles and further upon a blending ratio of these particles. In order to obtain high contrast, it is preferable to determine the ratio at which the two kinds of particles are blended so that they have nearly the same surface area. If there is a large deviation from this ratio, the color of the particle having the greater ratio becomes more prominent. This, however, is not true when the two kinds of particles are given dark and light tones of a similar color or when the color obtained by mixing two kinds of particles is utilized for the image.

Next, the substrate to be used in this embodiment can be structured by a general support member and electrode, besides by the foregoing substrate. The support member is of glass, plastics e.g. polycarbonate resin, acrylic resin, polyimide resin, polyester resin, epoxy resin or the like.

Moreover, the electrode can be an oxide of indium, tin, cadmium or antimony, composite oxide (e.g. ITO), metal (e.g. gold, silver, copper or nickel), and organic conductive material (e.g. polypyrrole, polythiophene). These can be used as a single film, mixture film or composite film, and formed by the deposition technique, sputtering technique, applying technique or the like. Also, the thickness is, usually, 100 to 2000 angstroms for the deposition or sputtering technique. The electrode can be formed into a desired pattern, e.g. matrix form, by the conventionally known means, e.g. etching for the conventional liquid crystal display device or printed board.

Moreover, the electrode may be embeded in the support member. In this case, because the material of the electrode also functions as a dielectric layer (described later) and may affect particle electrification properties or flowability, it is properly selected depending upon particle composition and the like.

Furthermore, the electrodes may be separated from the substrate and disposed outside the image display medium 12. In this case, because a display medium is disposed between the electrodes, the distance between the electrodes increases and the intensity of electric field decreases. Thus, in order to obtain a desired intensity of electric field, it is necessary to decrease the thickness of the substrate of the display medium or the distance between the substrates.

In the case that an electrode is formed on a support member, a dielectric film may be formed over the electrode as required in order to prevent the occurrence of leakage between the electrodes that may lead to electrode breakage or fixation of the particles to the electrodes. The dielectric film can be polycarbonate, polyester, polystyrene, polyimide, epoxy, polyisocianate, polyamide, polyvinyl alcohol, polybutadiene, polymethyl methacrylate, nylon copolymer, UV-curable acrylic resin, fluoroplastic or the like.

Also, besides the above insulating materials, it is possible to use an insulating material containing therein a charge transport substance. The charge transport substance provides the effect that particle electrifiability can be improved by injecting charge to the particles or, and that, when particle electrification amount is increased excessively, particle charge can be leaked to stabilize particle electrification amount.

Examples of the chare transport substance include hydrazone, stilbene compound, pyrazoline compound and arylamine compound which are hole transport substances. Moreover, it is possible to use fluorenone compound, diphenoquinone derivatives, pyrane compound, zinc oxide and the like as an electron transport substance. Furthermore, self-supportive resin having charge transportability can be used Specifically, it is possible to use polyvinyl carbazole, polycarbonate polymerized by the specific dihydroxyarylamine and bischloroformate described in U.S. Pat. No. 4,806,443.

The dielectric film influences the electrifying properties and flowability of particles and hence is properly selected in accordance with compositions of coloring particles or the like. The front substrate 18 is required to transmit light and a transparent one is preferably selected as the front substrate 18 from among the foregoing materials.

[Second Embodiment]

Next, explanation is made on the second embodiment of the invention.

Figure 12:
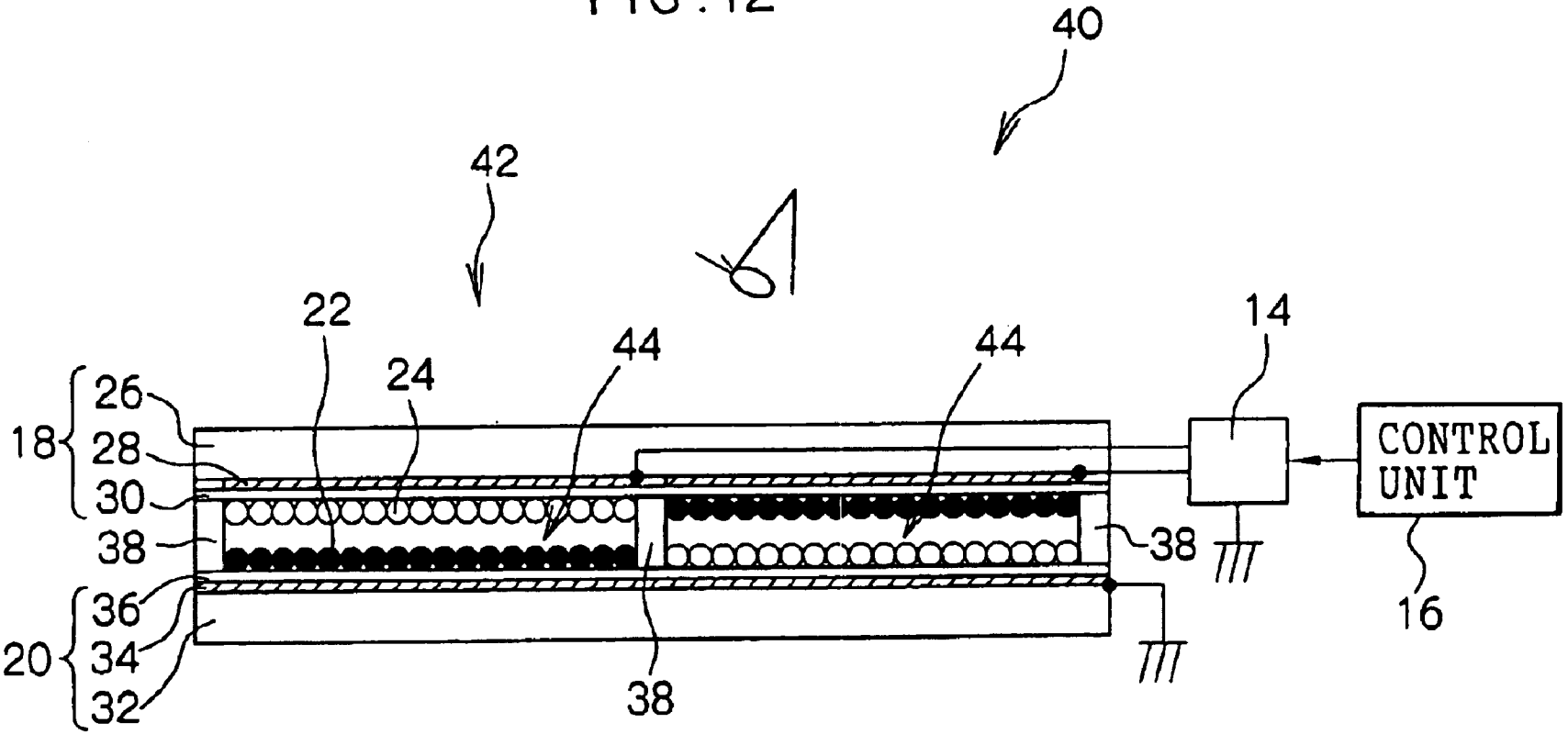
FIG. 12 is a schematic structural view of an image display device according to a second embodiment.

FIG. 12 shows a schematic structure of an image display device 40 according to a second embodiment. Components of the second embodiment which component is the same as those of the first embodiments have the same number as that of the first embodiment and the explanation thereof is omitted.

An image display device 40 has an image display medium 42, a voltage applying unit 14 and control unit 16.

In the image display medium 42, a space between a front substrate 18 and a rear substrate 20 is divided into a plurality of cells 44 by a gap member 38. The cell 44 encloses black particles 22 and white particles 24.

The image display medium 42 can have a front substrate 18 and a rear substrate 20 that are similar to those of the first embodiment.

The gap member 38 can be made with dry-film type photoresist. The gap member 38 can be formed by putting the photoresist on the rear substrate 20 and exposing it to a UV-ray through a mask having a desired pattern and removing unwanted portions of the resist. The gap member has a height (gap between the substrates) of 0.2 mm and a width of 0.1 mm.

The cells 44, defined by the gap member 38, were prepared to have different sizes of from 1 mm×1 mm to 15 mm×15 mm at a dimensional interval of 0.5 mm. Although the cells 44 were square in this embodiment, the shape of the cells is not limited to the same. Any shape, such as a rectangle or regular hexagon, can be employed.

The black particles 22 can be made, for example, by mixing spherical black particles which are made of cross-linked polymethyl methacrylate containing carbon and which have a volume average particle size of 10 $\mu$m (Techpolmer-MBX-Black, by Sekisui Fine Chemical), and an aerosil A130 fine particles treated with aminopropyl trimethoxy silane, in a weight ratio of 100:0.4. The white particles 24 may be made by mixing a spherical white particles which are made of cross-linked polymethyl methacrylate containing titanum oxide and which have a volume average particle size of 10 $\mu$m (Techpolmer-MBX-White by Sekisui Fine chemical), and titania fine powders treated with isopropyl trimethoxy silane, in a weight ratio of 100:0.2. It is possible to use a mixture of these black and white particles in a weight ratio of 3:4. In this case, the black particles 22 and white particles 24 are electrified by friction. Charges of black and white particles were measured by the charge spectrograph method after mixing them, the black particles 22 had a charge distribution whose average charge was about 10 fC while white particles 24 had a charge distribution whose average charge was about −11 fC.

A mixture of the black particles 22 and white particles 24 was evenly sifted through a screen and put into square cells 44 formed on the rear substrate 20. The total volumetric ratio of the black particlse 22 and white particles 24 to a space volume of the cell 44 was approximately 12%. An image display medium 42 can be formed by putting the front substrate 18 on the rear substrate 20 and holding the both substrates under pressure by the use of a double-clip.

Figure 13:
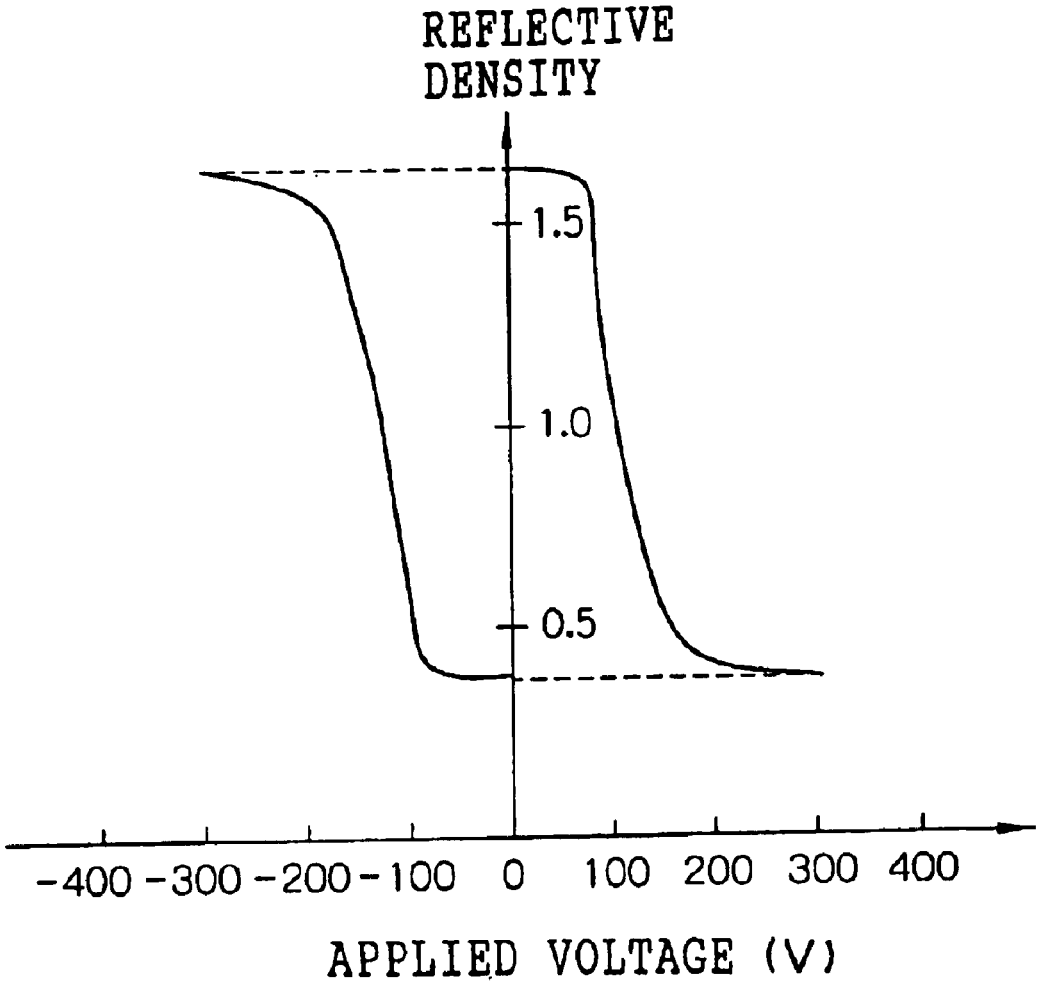
FIG. 13 is a graph showing a relationship between a reflective density and a voltage applied to the image display medium.

FIG. 13 shows a relationship between a display density and a voltage applied to the electrode 28 of the front substrate 18. Herein, display density was measured by a reflection densitometer (X-Rite404A, by X-Rite). The cell 44 had a size of 5 mm×5 mm. The measuring method included, first, the application of a +300V pulse voltage to the electrode 28 of the front substrate 18 of the image display medium 42 for 30 msec., to display white on the surface of the front substrate 18. Then, a negative pulse voltage was applied to the electrode 28 of the front substrate 18 for 30 msec., an density of the front substrate 18 surface was measured. Thereafter, +300V voltage was again applied to the electrode of the front substrate 18 for 30 msec., to again display white on the surface of the front substrate 18. The above process was repeated while gradually changing the negative pulse voltage between −300V and 0V.

Also, −300V voltage was applied to the electrode 28 of the front substrate 18 for 30 msec. similarly to the above, to display black on the surface of the front substrate 18 of prior to change of display. Then, a positive pulse voltage was applied to the electrode 28 of the front substrate 18 for 30 msec., and a density of the surface of the front substrate 18 was measured by the reflection densitometer. Thereafter, −300V voltage was again applied to the electrode 28 of the front substrate 18 for 30 msec., to again display black on the surface of the front substrate 18. The above process was repeated while gradually changing the value of positive pulse voltage applied between 0V and +300V.

As apparent from FIG. 13, it is seen that display densities nearly saturate in black and white display at an application voltage of ±200V. The display density of black is about 1.5 and that of white is about 0.4. It can be seen that it is possible to display images with high contrast.

Also, because the space between the substrates is divided by the gap member 38 into cells 44, the movement of the particles is restricted within the cells 44, thus eliminating the unevenness of display density due to particle localization. Thus, uniform images could be obtained.

Next, a pulse voltage having a voltage of ±200V and time of 30 msec. was applied repeatedly at an interval of 0.5 sec. to the electrode 28 of the front substrate 18 of the image display medium 12. When the number of times of change of display exceeded several tens, confirmed were occurrence of coloring-particle coagulation and adhesion of the particles to the gap member 38. When display was further repeatedly switched, cleat dot-like defects occurred while adhesion of the particles to the gap member 38 became conspicuous.

In this state, ±200V alternating voltage was applied to the electrode 28 of the front substrate 18 of the image display medium 42 while gradually changing the frequency, and it was observed whether the coagulation was dissociated. Thereupon, similarly to the first embodiment, where the frequency of alternating voltage was lower than 20 Hz, dissociation of coagulation and detaching of the particles from the gap member 38 were not observed and, the coagulation and adhesion of the particles to the gap member 38 proceeded. However, when the alternating voltage was raised to 20 Hz and over, observed were gradual dissociation of coagulation and detaching of particles from the gap member 38. When the frequency was raised to 50 Hz, coagulation was dissociated rapidly and particles were detached from the gap member 38. When the frequency was raised furthermore, dissociation of coagulation and detaching of the particles adhered on the gap member 38 were conducted favorably. These phenomena were observed until the frequency reached 3 kHz. However, when raised to 10 kHz, there was lower in effect despite observed were dissociation of coagulation and detaching of the particles from the gap member 38. After the frequency exceeded 20 kHz, there was almost no movement of particles. There were occurrences of new coagulation of particles and adhesion of particles onto the gap member 38.

Next, an alternating voltage having a voltage of ±200V and frequency of 1 kHz was applied to the electrode 28 of the front substrate 18 of the image display medium 12, thereby performing initialization. Thereafter, a pulse voltage having a voltage of 1200V and time of 30 msec. was repeatedly applied at an interval of 0.5 sec. to the electrode 28 of the front substrate 18 of the image display medium 12, to perform switching of display. Initialization was conducted each time of switching display, as shown in FIG. 9. The initializing drive voltage was kept constant at ±200V. A time the initializing voltage was applied was varied depending on the frequency such that alternating voltage was changed 10 times.

When the frequency of the alternating voltage was lower than 20 Hz, coagulation of particles and adhesion of the particles to the gap member 38 occurred conspicuously. As the alternating voltage was raised to 20 Hz and over, the occurrence of coagulation and particle adhesion to the gap member 38 became inconspicuous. When the frequency was raised to 50 Hz, virtually no coagulation occurrence and particle adhesion to the gap member 38 was observed. As the frequency was further raised to around 3 kHz, virtually no coagulation occurrence and particle adhesion to the gap member 38 was observed. However, when the frequency was raised to 10 kHz, slight occurrence of coagulation was observed. When the frequency exceeded 20 kHz, the particles during initialization do not move substantially, thus having less effect in preventing against coagulation occurrence and particle adhesion to the gap member 38.

Figure 14A:
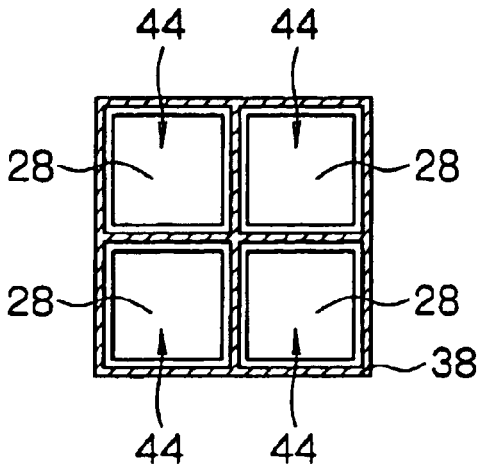
FIGS. 14A, 14B and 14C are views for explaining a relationship in arrangement of electrodes and a gap member.
Figure 14B:
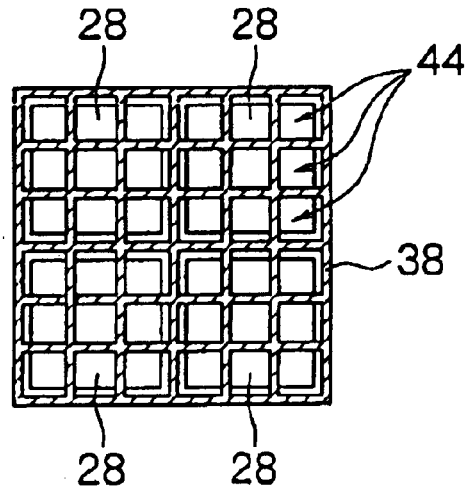
Figure 14C:
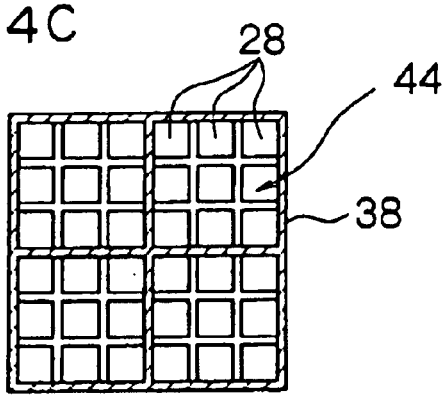

Herein, in the image display medium 42 shown in FIG. 12, each of the electrodes 28 corresponds to each of the cells. However, another relationship between the electrode patterns and the cells can be adopted, as typically shown in FIGS. 14A to 14C. FIG. 14A shows that each of the electrodes 2B and each of the cells 44 correspond to each other, similarly to the image display medium 42 shown in FIG. 12. FIG. 14B shows that a plurality of cells 44 correspond to one electrode 28. The structure shown in FIG. 14B is effective for an image display medium having a large-sized screen, especially for a large display pixel. FIG. 14C shows that a plurality of electrodes 28 are arranged within one cell 44, which is effective for a display medium having a high resolution, especially for a small display pixel.

Of these, there is no problem in the structure in which the cell has a size which is the same as or smaller than the size of the electrode. For the structure in which the cell has a size greater than the electrode and a plurality of electrodes are arranged within one cell, problems may arise depending on a method for applying an initializing drive voltage. This is because, if a voltage for forming an alternating electric field is applied as an initializing drive voltage to only some electrodes within the cell, the particles near the electrode to which the voltage is applied also move in a direction other than a thickness direction of the display medium while reciprocally moving, so that the particles may localize within the cell and it is difficult to conduct even initialization within the cell. Accordingly, when using a display medium having a plurality of electrodes arranged within one cell as shown in FIG. 14C, it is preferred to simultaneously apply an initializing drive voltage to all the electrodes within the cell.

In this embodiment, when using an image display medium having a plurality of electrodes within one cell, an initializing drive voltage is simultaneously applied to all the electrodes within the cell, such that at least one cell is initialized. This causes all the particles within the cell to simultaneously, reciprocally move, making it possible to favorably carry out initialization without causing particle localization in the cell. When an initializing drive voltage was applied to part of the electrodes in the cell and an initializing drive voltage was applied sequentially to the electrodes in the cell, observed was uneven density due to particle localization or occurrence of defects as compared to the case where an initializing drive voltage was simultaneously applied to all the electrodes within the cell.

If using a structure in which one electrode corresponds to one cell as shown in FIGS. 12 and 14A and the initializing drive voltage is combined with the display drive voltage into one drive voltage as shown in FIG. 9, it is possible to prevent the occurrence of coagulation and particle adhesion to the gap member 38 to enable favorable repetition of display without separately providing an initializing drive sequence. Also, when changing display, eliminated is flicker on the display surface which flicker is observed in the case an initializing drive voltage is simultaneously applied to all over the display surface. Thus, change of display can be conducted successively.

[Third Embodiment]

Now, explanation is made on a third embodiment of the invention. In this embodiment, a case in which the image display medium is disposed vertically is explained. Components of this embodiment which are the same as those of the foregoing embodiments have the same reference numerals as those of previous embodiments and detailed explanation thereof is omitted.

Figure 15:
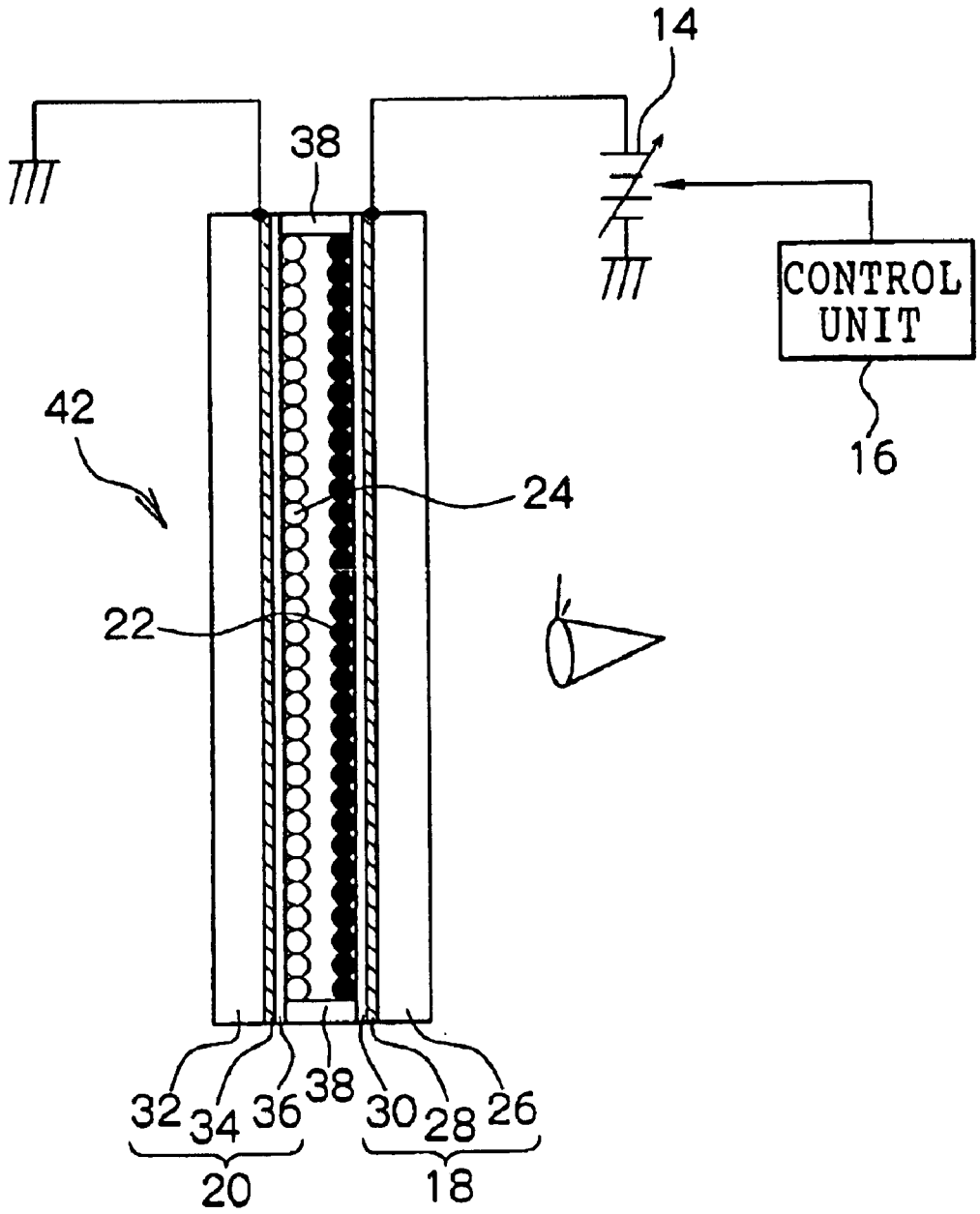
FIG. 15 is a schematic structural view of an image display device according to a third embodiment.

The image display medium has the image display medium 42 explained in the second embodiment, and is disposed vertically as shown in FIG. 15. Herein, FIG. 15 shows only one of a plurality of cells 44 divided by the gap member 38, for simplicity of explanation. The initial display state of the image display medium 42 is formed by carrying out initialization and image display in a state the display surface of the image display medium 42 is disposed horizontally. Note that the image display medium 12 used in this embodiment has a cell 44 size of 15 mm×15 mm, as one example.

To the electrode 29 of the front substrate 18 of the image display medium 12, a pulse voltage having a voltage of ±200V and time of 30 msec. was repeatedly applied at an interval of 0.5 second by the voltage applying unit 14. Display contrast began lowering in an upper region of the cell 44 due to fall of coloring particles when the number of times of change of display exceeded several tens. When repeating display furthermore, the particles disappeared in the upper region of the cell 44, and it was impossible to display images in the upper region. When repeating display furthermore, the particles ultimately deposited in a lower region of the image display medium 42 and it was impossible to display images as shown in FIG. 16.

Figure 17:
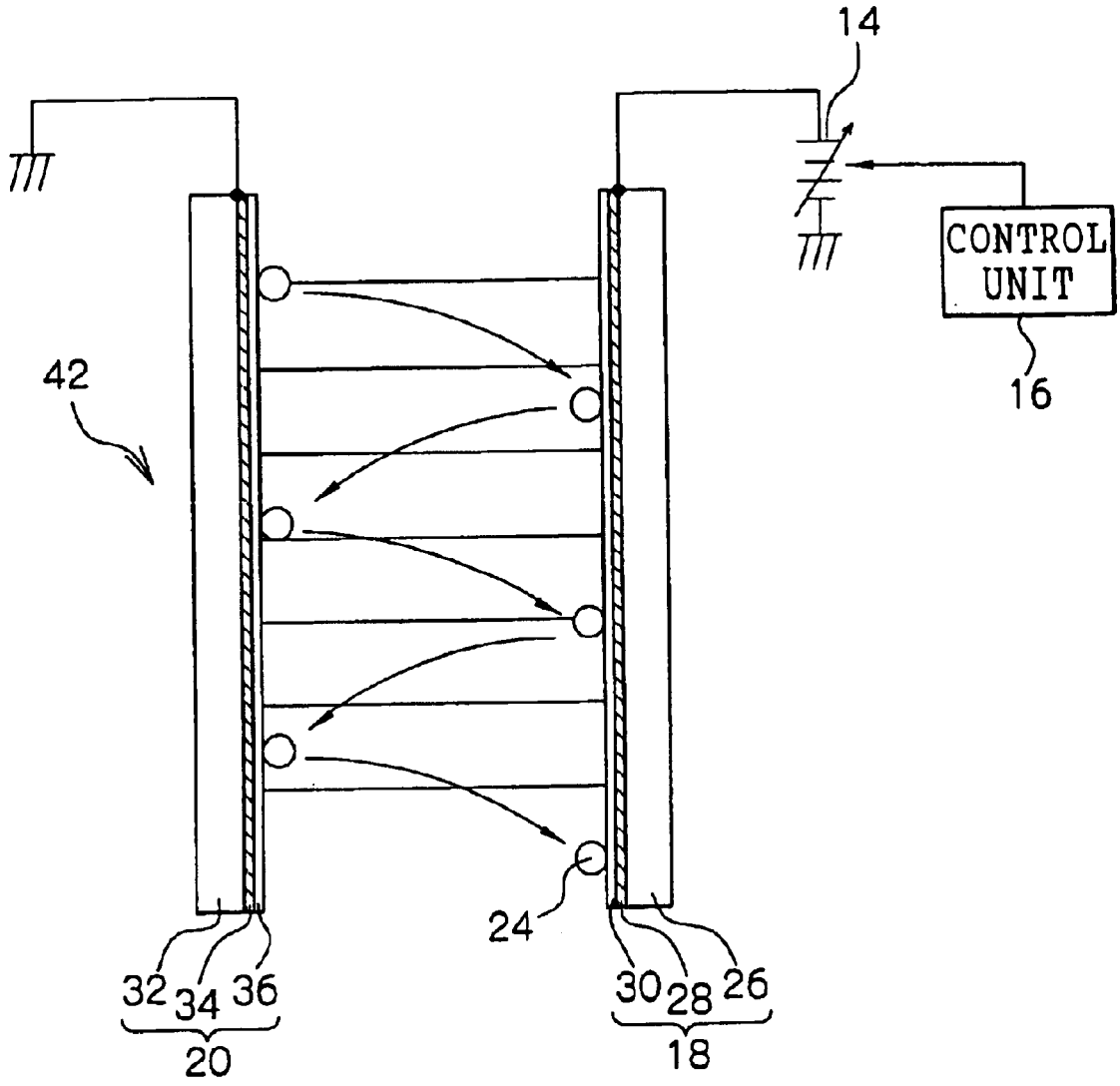
FIG. 17 is a view for explaining the movement of a particle.

This is because, in a state in which the image display medium is displayed vertically, when the particles move in the gap between the substrates according to the electric field, they always accepted a downward force due to the action of gravity. FIG. 17 typically shows a moving path of the white particle 24 when changing display. The particle gradually moves downward as images are changed.

In this case, the particles were driven by the display drive voltage to a height of approximately 1 mm from the upper surface of the deposited particles.

Figure 16:
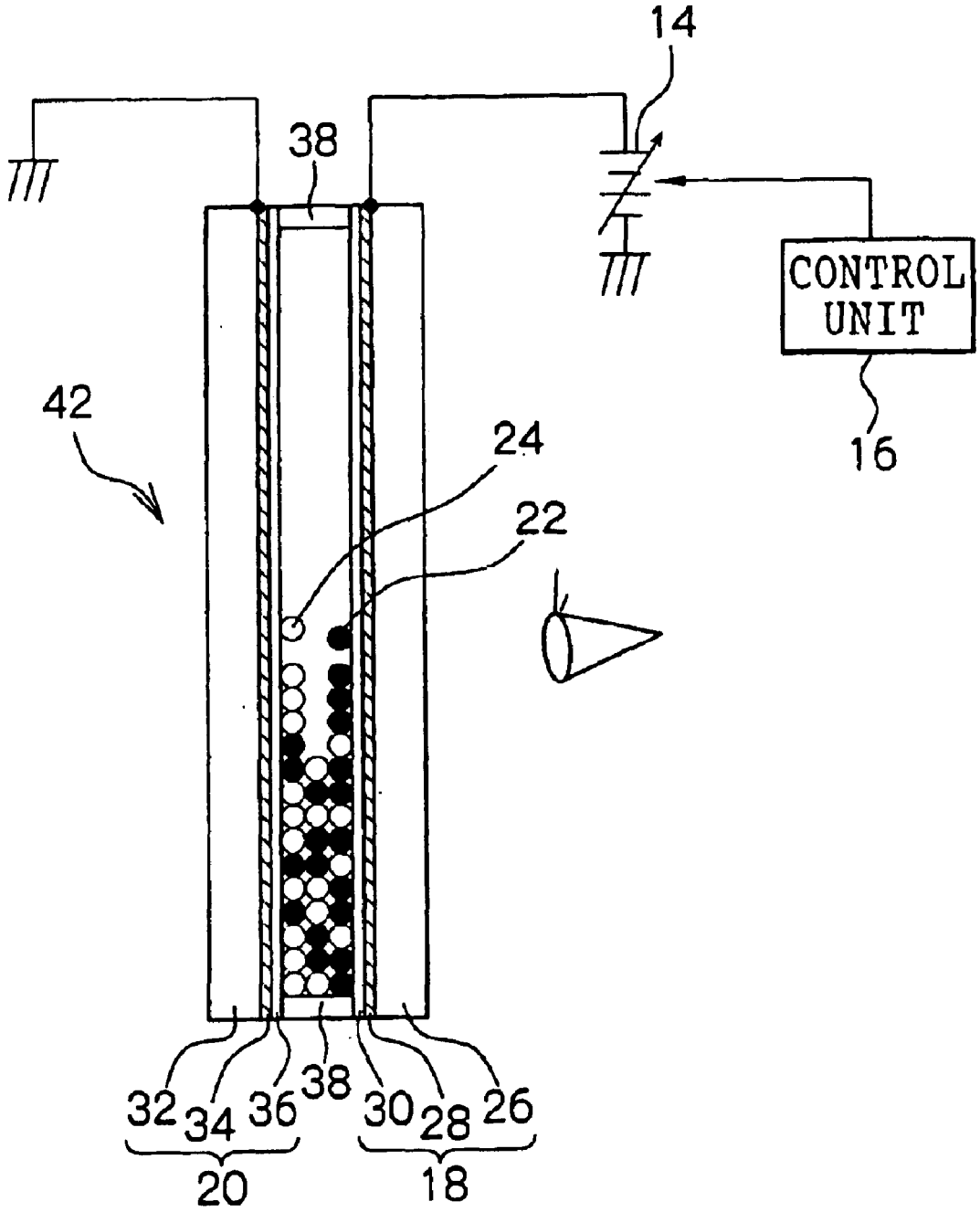
FIG. 16 is a view showing a state that particles are deposited in a lower region of the image display medium.

Next, an alternating voltage of ±200V was applied to the electrode 28 of the front substrate 18 of the image display medium 42 while gradually changing the frequency thereof in the state the particles were deposited in the lower region of the image display medium 42 as shown in FIG. 16, and a particle drive state was observed. When the frequency of alternating voltage was lower than 20 Hz, no change was observed in the particle drive state. However, when the alternating voltage was raised to 20 Hz and over, the particles gradually began diffusing upward. When the frequency was raised furthermore, the particles diffused to a maximum height of approximately 10 mm from the above-described upper surface. When the frequency was further raised to around 3 kHz, the height of particle diffusion began lowering. When exceeding 20 kHz, the particles almost lose movement and upward diffusion became not observed.

Figure 18:
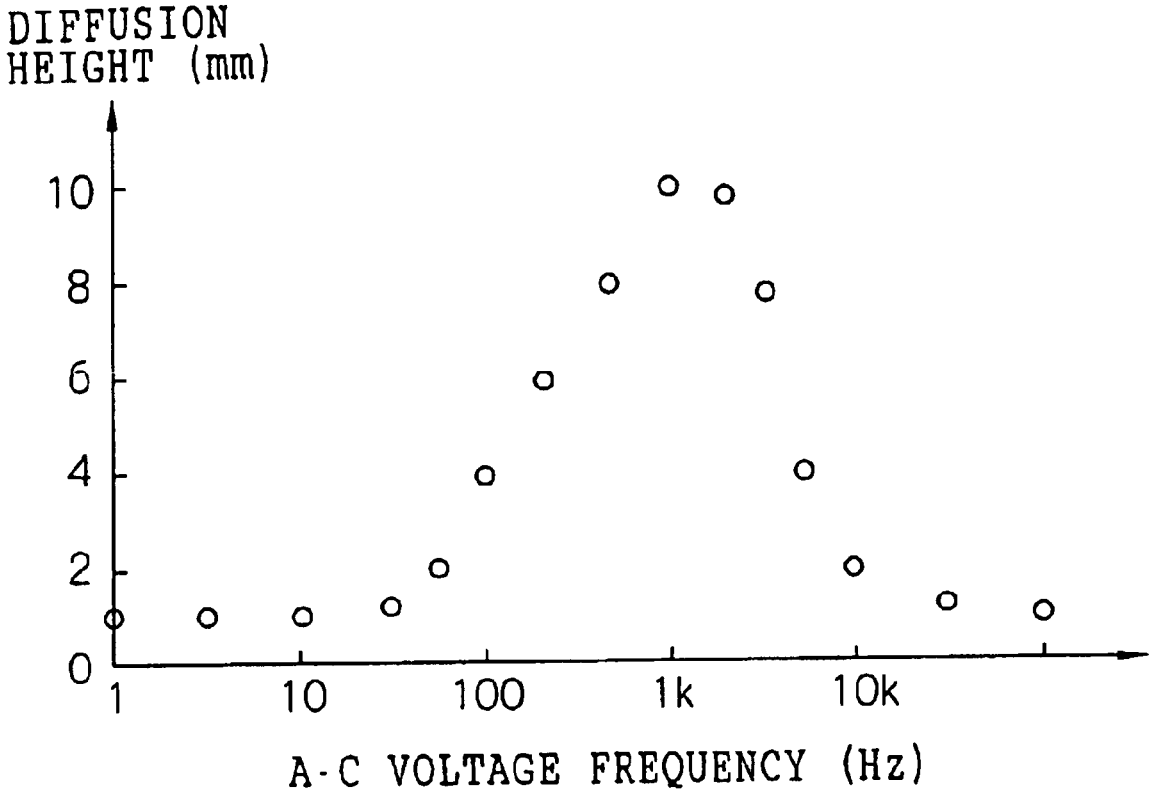
FIG. 18 is a figure explaining a relationship between a diffusion height and a frequency of an alternating voltage.

FIG. 18 shows a relationship between a particle diffusion height (distance from the upper surface of the deposited particles) and an alternating-voltage frequency. As apparent from FIG. 18, it can be seen that, in the case the frequency of alternating voltage is higher than 20 Hz but lower than 20 kHz, the slight effect of upward diffusion of particles is observed and, when higher than 50 Hz but lower than 10 kHz, the effect of particle upward diffusion is positively obtained. In particular, it can be seen that the higher diffusion effect is obtained in the case where the frequency is higher than 50 Hz but lower than 10 kHz. If the application of alternating voltage is stopped after particles are upwardly diffused and a display drive voltage is applied, preferred display with high contrast is possible in the particle-diffused region.

The reason for the phenomenon of upward diffusion of particles due to application of alternating voltage may be that the rapid reciprocating motion of particles between the substrates due to an alternating electric field causes collisions between the particles and that collided particles move upward due to the repellusion.

Next, in a state that the display surface of the image display medium 42 was disposed horizontally, an alternating voltage having +200V and frequency of 1 kHz was applied to the electrode 28 of the front substrate 18 to carry out initialization, and then black was displayed on the entire display surface as shown in FIG. 15. Thereafter, while gradually changing the frequency, the ±200V alternating voltage was applied to the electrode 28 of the front substrate 18, and a particle drive state was observed. As a result, the height the falling of particle halts was different depending on a frequency of applied alternating voltage and the height was nearly equivalent to the particle diffusion height shown in FIG. 18.

Next, prepared was an image display medium 42 having a cell 44 size of 10 mm×10 mm. In a state the display surface of the image display medium 42 was disposed horizontally, an alternating voltage having ±200V and frequency of 1 kHz was applied to the electrode 28 of the front substrate 18 to carry out initialization, and black was displayed on the entire display surface as shown in FIG. 15. Thereafter, the image display medium 42 was disposed vertically and a pulse voltage having a voltage of ±200V and time of 30 msec. was repeatedly applied at an interval of 0.5 sec. to the electrode 28 of the front substrate 18, to conduct change of display. Initialization was carried out each time display was changed, as shown in FIG. 9. In this initialization, an alternating voltage having ±200V and frequency of 1 kHz was applied to the electrode 28 of the front substrate 18 of the vertically disposed image display medium 42 for 10 msec.

Figure 19:
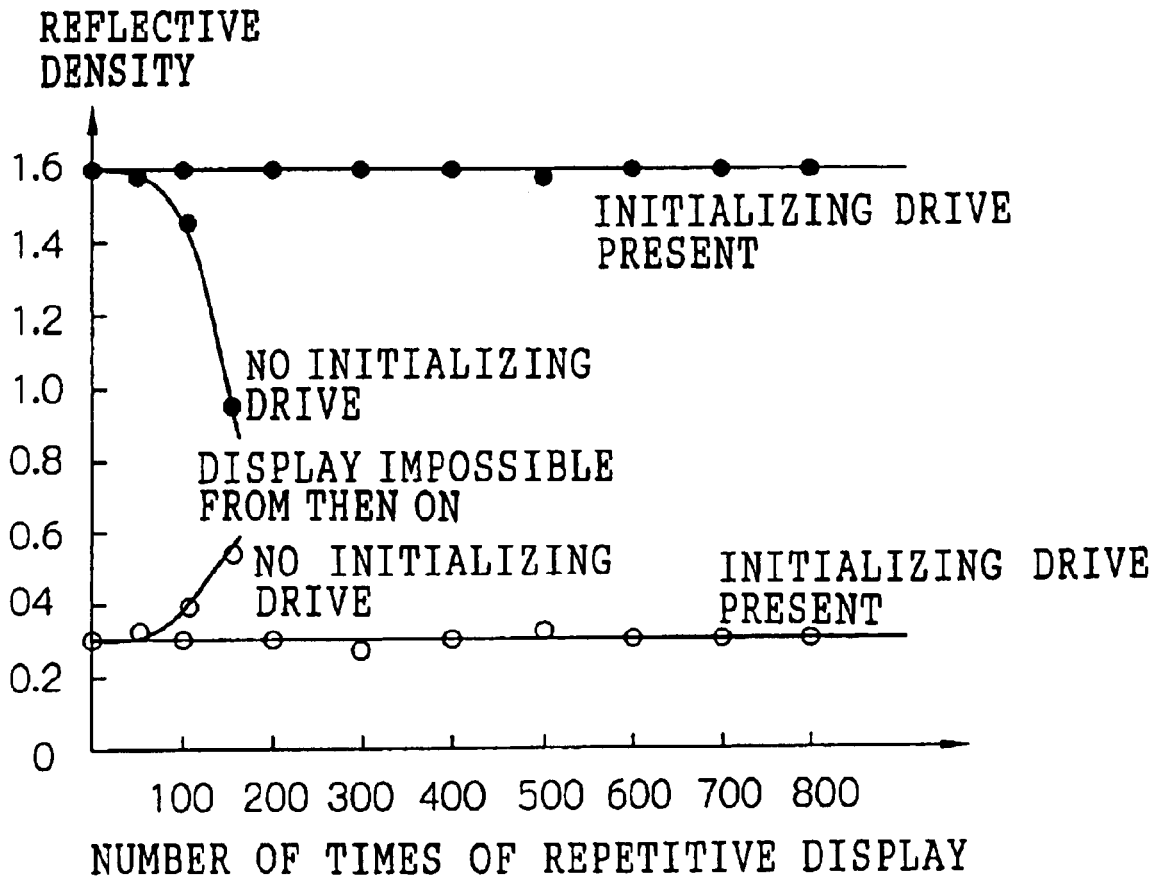
FIG. 19 is a diagram showing a relationship between a reflective density and the number of times of change of images.

FIG. 19 shows a relationship, in the above case, between a reflection density of a cell center and the number of times of change of display. As apparent from FIG. 19, it can be seen that, even if the image display medium 42 is disposed vertically, initialization can prevent the particles from falling due to gravity, thus making it possible to carry out stable, repetition of display with high contrast. FIG. 19 also shows a relationship between the reflection density in the cell center and the number of times of change of display in case of no initialization. It is seen that display density remarkably deteriorates due to fall of particles and it is impossible to display images when display is changed about 200 times.

If an image display medium 42 having a cell 42 size of 1 mm×1 mm is disposed vertically, fall of the particles is almost not observed even if initialization is not conducted. However, required is initialization for preventing particle coagulation and particle adhesion to the gap member 38.

However, in this case, density of the white image increases depending on the color of a gap member. This is because the cells having 1 mm×1 mm are defined by a gap member 38 having a width of 0.1 mm, the ratio of the area of the gap member 38 to the entire display area reaches about 18% and the color of the gap member 38 affects display color. If a dark-blue gap member 38 (dry film for photo-etching) is used, white color is particularly influenced by the color of the gap member and looks bluish. If the gap member 38 is non-chromatic (e.g. white), there is no problem in white display but black density decreases. On the other hand, if the gap member 38 is black, white display becomes gray. Even if the gap member 38 is grays contrast of display is eventually lowered.

In contrast, in the present embodiment, a cell having 10 mm×10 mm can be used to prevent fall of particles. In this case, because the ratio of the area of the gap member 38 to the entire display area is about 2%, the lowered display contrast and display color change are not challenged.

It is conceivable to narrow the width of the gap member 38 to reduce the effect of color of the gap member 38. This, however, is not practical in view of the problem with strength of the gap member 38, manufacturing difficulty and the increase of manufacture cost.

[Fourth Embodiment]

Next, explanation is made on a fourth embodiment of the invention. Although the foregoing embodiment explained the case initialization is made each time of changing display, in this embodiment, a case in which initialization is conducted once per a plurality of number of times of changes of display. Components which are the same as those of previous embodiments have the same reference numerals and explanation thereof is omitted.

The image display medium of this embodiment is the same as the image display medium 42 described in the second embodiment that has a cell 44 size of 10 mm×10 mm.

First, an alternating voltage having a voltage of ±200V and frequency of 1 kHz was applied to the electrode 28 of the front substrate 18 of the image display medium 42, thereby forming a state of preferred display. Thereafter, a pulse voltage having a voltage of ±200V and time of 30 msec. was repeatedly applied at an interval of 0.5 sec. to the electrode 28 of the front substrate 18 to change display. Initialization was conducted every 200 changes of display. In the initialization, an alternating voltage having a voltage of ±200V and frequency of 1 kHz was applied to the electrode 28 of the front substrate 18 for 20 msec.

Figure 20:
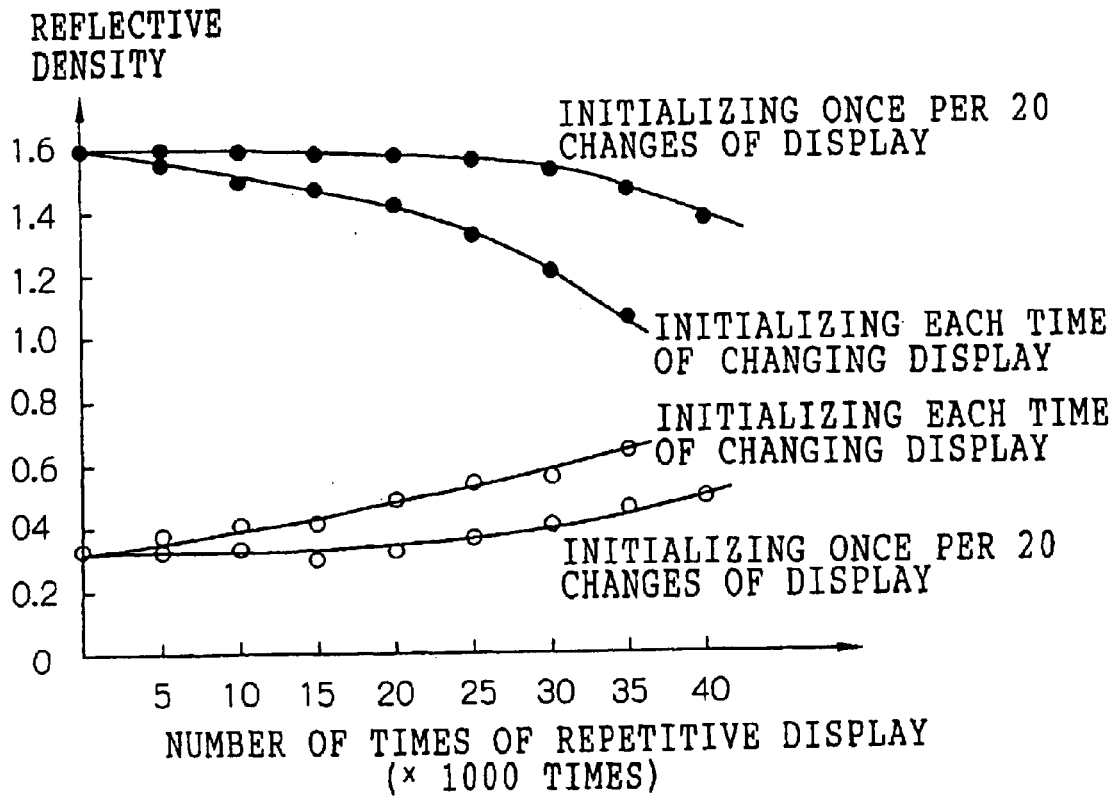
FIG. 20 is a diagram showing a relationship between a reflective density and the number of times of change of images.

FIG. 20 shows a relationship between a display density and the number of times of change of display. FIG. 20 also shows a result in a case where the same image display medium was used and an alternating voltage having a voltage of ±200V and frequency of 1 kHz was applied to the electrode 28 of the front substrate 18 for 10 msec. each time of changing of display. As apparent from FIG. 20, it can be seen that the repetitive-display characteristic in a case where the initialization was conducted every 20 times of changes of display was better than that in a case where the initialization was conducted each change of display. The reasons for this may be that, because initialization utilizes a mechanical impact force due to reciprocating motion of particles, the deformation of the particles and abrasion of substrate surface progress due to the collision between the particles or between the particle and the substrate, and the particles and substrate deteriorate, which result in deterioration in display characteristic. Accordingly, It can be considered that the deterioration in the display medium can be reduced by reducing the number of times of initialization.

Particle coagulation, fall of the particles and adhesion of the particles to the gap member 38 progress gradually in each of display drive. If several to several tens of changes of display are conducted without initialization, they are not recognized as defects. There is no problem in display performance as long as initialization is carried out before recognizing them as defects.

Moreover, the time for applying an initializing drive voltage differs depending on types of coloring particles and substrate to be used, initializing drive voltage frequency and interval at which initialization is to carry out. Accordingly, it is properly determined in accordance with the conditions of them.

[Fifth Embodiment]

Next, explanation is made on a fifth embodiment of the invention. This embodiment explains a case that changed is a voltage value of the alternating voltage to be applied upon initialization. Components which are the same as those of previous embodiments have the same reference numerals and explanation thereof is omitted.

The image display medium of this embodiment is the same as the image display medium 42 explained in the second embodiment and having a cell 44 size of 10 mm×10 mm.

First, an alternating voltage having a voltage of ±200V and frequency of 1 kHz was applied to the electrode 28 of the front substrate 19 of the image display medium 12, thereby forming a state of preferred display. Thereafter, a pulse voltage having a voltage of ±200V and time of 30 msec. was repeatedly applied at an interval of 1 sec. to the electrode 28 of the front substrate is to change display. Initialization was made each change of display. In the initialization, an alternating voltage having a frequency fixed at 1 kHz was applied for 10 msec.

FIG. 21 shows a relationship between a voltage value of the alternating voltage in initialization and an effect of prevention against particle coagulation and effect of prevention against adhesion of the particles to the gap member 38.

As apparent from FIG. 21, it can be seen that, when the alternating voltage value of initialization is changed, the particle coagulation and adhesion of the particles to the gap member 38 begin to decrease at around an alternating voltage value of ±100V and they almost do not occur at ±150V and over. Accordingly, the alternating voltage value in initialization is not necessarily the same as the voltage value in display drive. Initialization can be made well at a voltage lower than the display drive voltage. When the alternating voltage is raised furthermore, the effect of prevention against particle coagulation and adhesion of the particles to the gap member 38 is further enhanced at from ±250V to ±300V. However, particle coagulation begins to occur at about ±400V or the above.

Figure 22:
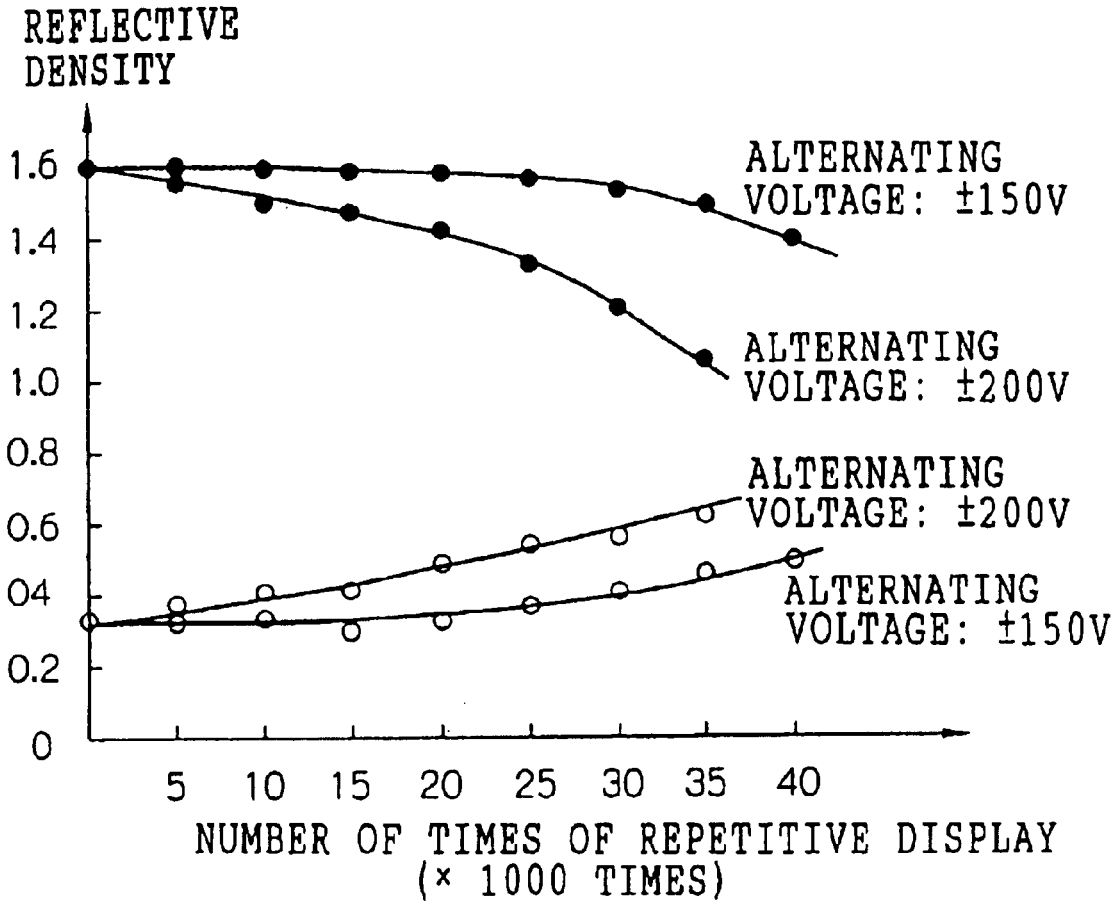
FIG. 22 is a diagram showing a relationship between a reflective density and the number of times of change of images.

FIG. 22 shows a relationship between a display density and the number of repetition of display on the cases where the alternating voltage value upon initialization is ±150V and ±200V. As apparent from FIG. 22, it can be seen that the characteristic of repetitive display is preferred when the alternating voltage value is ±150V on initialization as compared to the case with the alternating voltage value of ±200V. The reason for this may be that the lower initializing drive voltage can decrease the deterioration in the particle or substrate due to mechanical collision of particles upon initialization and decrease the deterioration in the display medium to be caused by that.

[Sixth Embodiment]

Next, explanation is made on a sixth embodiment of the invention. This embodiment explains a case that the image display medium is disposed vertically similarly to the third embodiment and changed is a voltage value of the alternating voltage to be applied upon initialization. Components which are the same as those of previous embodiments have the same reference numerals and explanation thereof is omitted.

The image display medium of this embodiment is the same as the image display medium 42 explained in the second embodiment and having a cell 44 size of 15 mm×15 mm.

First, in a state the image display medium 42 was positioned horizontally, an alternating voltage having a voltage of ±200V and frequency of 1 kHz was applied to the electrode 28 of the front substrate 18 to carry out initialization, thereby forming a state of preferred display. Thereafter, the image display medium 42 was disposed vertically and a pulse voltage having a voltage of ±200V and time of 30 msec. was repeatedly applied at an interval of 1 sec. to the electrode 28 of the front substrate 18, to perform initialization each time of changing display. In the initialization, an alternating voltage having a frequency of 500 Hz was applied for 20 msec.

Figure 23:
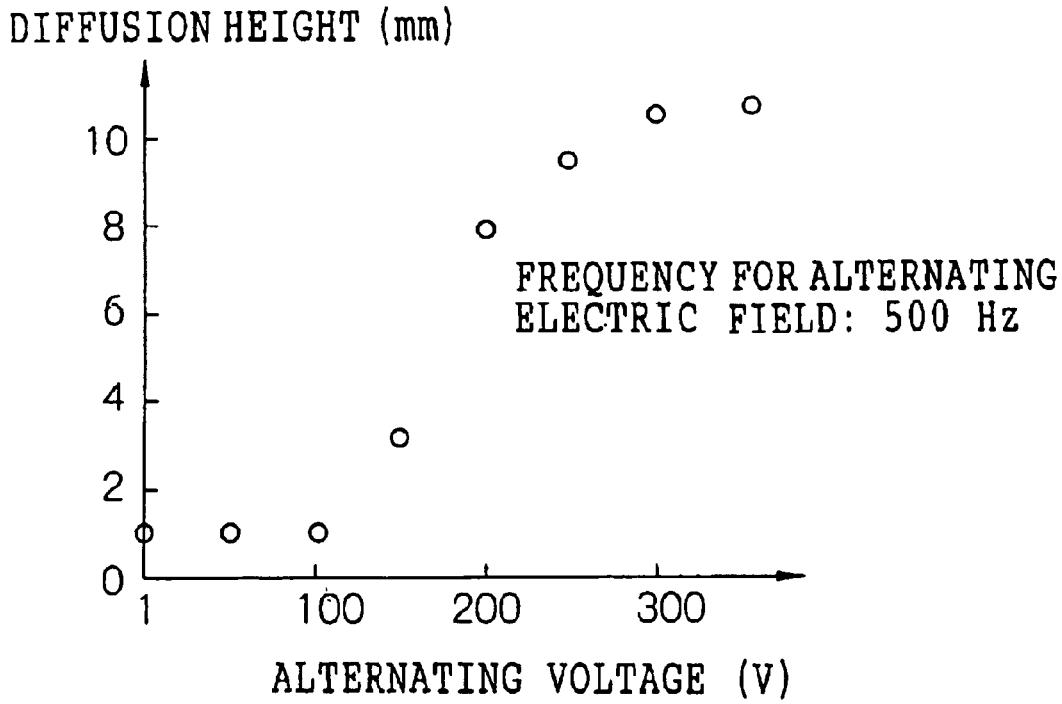
FIG. 23 is a figure for explaining a relationship between a diffusion height and an alternating voltage.

As display was repeatedly conducted, the particles fell gradually and the falling of the particles stopped to a certain height of the cells. In the areas between bottom of the cells and the height, display could be conducted. FIG. 23 shows a relationship between a voltage value of the alternating voltage applied upon initialization and a height of display at which the falling particles halted upon repeating display and in an area under which display could be conducted stably (height of the highest particle from a lowermost point of the cell: diffusion height). As apparent from FIG. 23, it can be seen that the height of display begins to slightly rise when the alternating voltage in initialization is greater than ±100V and the height of display increases as the alternating voltage increases. The reason for this may be that the increase of alternating voltage increases particle velocity and collision repelling force, which lead to the particles are diffused to a higher position.

Accordingly, the increase of alternating voltage in initialization can increase the height of the areas of cells in which areas display can be conducted, thereby enabling the larger cell size. Thus, it is possible to display images with higher contrast.

However, it is preferred to carry out initialization every a plurality of number of times of changes of display because increase in particle collision force due to increasing the initializing drive voltage may accelerate deterioration of the image display medium. As described before, though particle fall occurs in a slight amount each time of changing display, it is not recognized as defects if the initialization is conducted every several to several tens in the number of times of change of display. Accordingly, it is preferable to perform initialization before defects are recognized. This can suppress the image display medium from deteriorating to the utmost as mentioned before and effectively prevent the particles from falling.

Moreover, a combination of two kinds of alternating voltages, i.e. an initializing drive voltage equal to or lower than the display drive voltage and an alternating voltage higher than the display drive voltage, can be used. For example, initialization is basically carried out with an alternating voltage (±150V) lower than a display drive voltage (±200V) and, at an interval of once per a certain number of times of initialization, with an alternating voltage (e.g., ±250V) higher than the display drive voltage, thereby making it possible to suppress as less as possible the image display medium from deteriorating due to initialization and effectively prevent the particles from falling.

[seventh Embodiment]

Next, explanation is made on a seventh embodiment of the invention. This embodiment explains a case using a magenta-colored particles in place of the black particles. Note that the same reference numerals are attached to the same parts as those of the foregoing embodiment so as to omit detailed explanation.

In this embodiment, magenta-colored particles are used as one kind of coloring particles and are mixed with the white particles having a particle size of 10 $\mu$m and used in the second embodiment in a weight ratio of 1:2 (magenta particles:white particle). The magenta particles to be used in this embodiment can be obtained in the following procedure.

First, 100 parts by weight of polyester resin, 4 parts by weight of C.I. pigment Red 57 and 110 parts by weight of ethyl acetate are stirred in a ball mill for 48 hours into a liquid-A. On the other hand, a 2% solution of carboxy methylcellulose is prepared in 100 parts by weight into a liquid-B. Next, 100 parts by weight of liquid-B is stirred in an emulsifier and 50 parts by weight of liquid-A is poured slowly thereto and the resultant mixture solution is suspended. Thereafter, ethyl acetate is removed under reduced pressure and then washing, drying and classifying is conducted to obtain desired magenta particles. The magenta particles are mixed with a titania fine powder treated by isopropyl trimethoxy silane in a ratio by weight of 100:0.1. The magenta particles have an average particle size of 7 $\mu$m. Also, in this embodiment, the white particles to be used are not mixed with titania fine powders treated with isopropyl trimethoxy silane. By mixing the two kinds of the particles, the magenta particles are electrified negative while the while particles positive.

Then, the foregoing mixed particles are enclosed in a space between the substrates of the image display medium 12 explained in the first embodiment, in a ratio of the total volume of coloring particles to the gap volume between the substrates of 14%. Then, a pulse voltage having ±400V and time of 30 msec. was applied to the electrode 28 of the front substrate 18 of the image display medium 12 at an interval of 0.5 sec. Preferred display was repeated in the first several times. However, occurrence of particle coagulation was confirmed when the number of times of change of display exceeded ten. When change of display was repeated furthermore, defects occurred in a clear dot form.

Next, an alternating voltage having ±400V and frequency of 1 kHz was applied as an initializing drive voltage to the image display medium 12 in which the dot-like defects had occurred. However, dissociation of particle coagulation was not observed and coagulation was accelerated. Although the frequency of initializing drive voltage was varied from several Hz to several tens Hz and the voltage value was changed from ±300V to 500V, there found no dissociation effect of coagulation. The reason for this is that the movement characteristic of the magenta particles is different from that of the white particles because of the difference in particle electrifying characteristic, adhesion force of the particles to the substrate, adhesion force between particles, etc. and the two kinds of coloring particles could not be driven with balance only by the alternating voltage.

Next, an initializing drive voltage in which a direct current voltage was superposed on the alternating voltage and an initialization state was observed. An alternating voltage having ±400V and frequency of 1 kHz and a direct current voltage were applied simultaneously to the electrode 28 of the front substrate 18, while the direct voltage being changed. Thereupon, particle coagulation began to dissociate when the direct current voltage exceed ±25V. when the direct current voltage was nearly +50V, particle coagulation dissociated rapidly. When the direct current voltage was increased furthermore, the magenta particles began to adhere to the front substrate 18 and ultimately the magenta particles covered the display surface and halted movement. Moreover, when a negative direct current was used together the alternating voltage, particle coagulation progressed and the white particles began to adhere to the front substrate 18, making it impossible to initialize.

Consequently, even if using such a combination of particles as cannot be initialized only by an alternating voltage, the simultaneous use of the alternating voltage and a proper direct current voltage, as in this embodiment, enables preferred initialization.

[Eighth Embodiment]

Next, explanation is made on an eighth embodiment of the invention. This embodiment explains a case in which, as an initializing drive voltage, an alternating voltage varied in duty is applied. Note that the same reference numerals are attached to the same parts as those of the foregoing embodiment to omit detailed explanation.

The voltage applying unit 14 has a function to change a duty of an alternating voltage. The duty of the applied voltage is varied in accordance with an instruction of the control unit 16.

Figure 24:
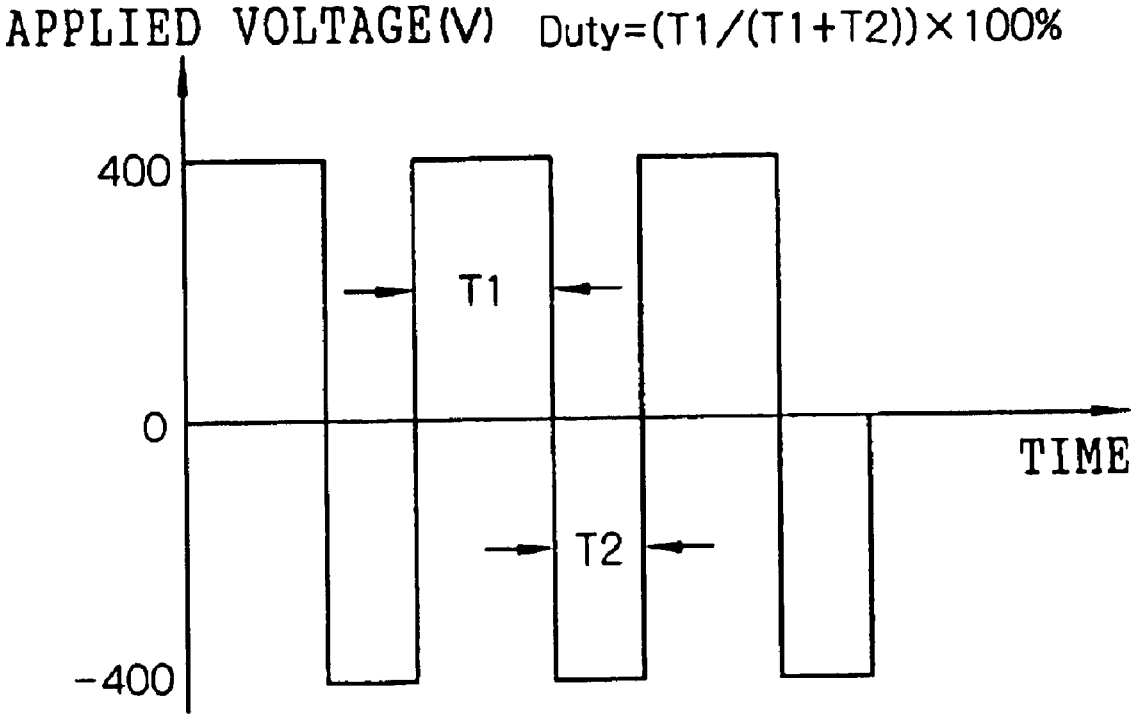
FIG. 24 is a figure for explaining a method for applying a voltage to the image display medium.

The image display medium of this embodiment is similar to that explained in the seventh embodiment. An alternating voltage varied in duty was applied as an initializing drive voltage and the initialization state was observed. In this embodiment, as shown in FIG. 24 the duty value was a ratio of a positive pulse-voltage application time to a one-cycle time of the alternating voltage. The duty value was varied at an interval of 5% between 10% and 90%.

First, a pulse voltage having a voltage of ±400V and time of 30 msec. was repeatedly applied at an interval of 0.5 second to the electrode 28 of the front substrate 18 of the image display medium, thereby causing dot-formed defective display. Next, an alternating voltage having ±400V and frequency of 1 kHz was applied to the electrode 28 of the front substrate 18 while changing the duty of the alternating voltage. No dissociation of particle coagulation was found at a duty of between 10% to 50% and the white particles began to adhere to the front substrate 19, and the effect of initialization was not observed. When the duty was raised to 55%, particle coagulation began to dissociate. When the duty was raised to 60%, particle coagulation rapidly dissociated. When the duty was raised furthermore, the magenta particles began to adhere to the front substrate 18. Ultimately, the magenta particles covered the front surface and lost movement.

Accordingly, in the present embodiment, preferred initialization can be carried out even if a combination of particles which cannot be initialized by an alternating voltage having a duty of 50% is used, similarly to the explanation in the seventh embodiment.

What is claimed is:

1. An image display device, comprising:

an image display medium having a pair of substrates, an electrode provided on each respective substrate, and a plurality of kinds of particles which are enclosed in a space between the substrates and which are movable due to an electric field formed between the electrodes and which have different colors and electrifying properties; and a voltage applying unit for applying to the electrodes a display drive voltage for displaying images on the image display medium and an alternating voltage for preventing particle coagulation, wherein the alternating voltage is other than the display drive voltage and has a frequency to move the plurality of kinds of particles.

2. The image display device according to claim 1, wherein the frequency of the alternating voltage is from 20 Hz to 20 kHz.

3. The image display device according to claim 1, wherein the image display medium further comprises a gap member for maintaining a predetermined gap between the pair of substrates and dividing the space between the substrates into a plurality of cells, with the voltage applying unit applying the alternating voltage per cell.

4. The image display device according to claim 1, wherein the frequency of the alternating voltage is from 50 Hz to 10 kHz.

5. The image display device according to claim 1, wherein the voltage applying unit applies the alternating voltage to the electrodes once per a plurality of number of times of changes of image on the image display medium.

6. The image display device according to claim 1, wherein the voltage applying unit applies to the electrodes the alternating voltage lower than a display drive voltage for displaying images on the image displaying medium.

7. The image display device according to claim 1, wherein the voltage applying unit applies to the electrodes the alternating voltage higher than a display drive voltage for displaying images on the image displaying medium.

8. The image display device according to claim 1, wherein the voltage applying unit applies to the electrodes, at a predetermined ratio, the alternating voltage equal to or lower than a display drive voltage for displaying images on the image displaying medium and the alternating voltage higher than the display drive voltage.

9. The image display device according to claim 1, wherein the voltage applying unit applies simultaneously a predetermined direct current voltage and the alternating voltage to the electrodes.

10. The image display device according to claim 1, wherein the voltage applying unit includes a changing unit for changing a duty of the alternating voltage.

11. A display drive method for an image display medium having a pair of substrates, an electrode provided on each substrate respectively, and a plurality of kinds of particles which are enclosed in a space between the substrates and which are movable due to an electric field formed between the electrodes and which have different color and electrifying properties, the display drive method comprising:

applying to the electrodes a display drive voltage for displaying images on the image display medium and an alternating voltage for preventing particle coagulation, wherein the alternating voltage is other than the display drive voltage and has frequency to move the plurality of kinds of particles.

12. The display driving method according to claim 11, wherein the frequency of the alternating voltage is from 20 Hz to 20 kHz.

13. The display driving method according to claim 11, wherein the frequency of the alternating voltage is from 50 Hz to 10 kHz.

14. The display driving method according to claim 11, wherein the alternating voltage is applied to the electrodes once per a plurality of number of times of changes of image on the image display medium.

15. The display driving method according to claim 11, wherein the alternating voltage is lower than the display drive voltage for displaying images on the image displaying medium.

16. The display driving method according to claim 11, wherein the alternating voltage is higher than the display drive voltage for displaying images on the image displaying medium.

17. The display driving method according to claim 11, wherein the alternating voltage equal to or lower than a display drive voltage for displaying images on the image displaying medium and the alternating voltage higher than the display drive voltage are applied at a predetermined ratio to the electrodes.

18. The display driving method according to claim 11, wherein the alternating voltage and a predetermined direct current voltage are applied simultaneously to the electrodes.

19. The display driving method according to claim 11, wherein a duty of the alternating voltage is changed.

* * * * *